US011214091B2

(12) United States Patent
Pascua et al.

(10) Patent No.: US 11,214,091 B2
(45) Date of Patent: Jan. 4, 2022

(54) SECURE PACKS FOR TRANSACTION CARDS

(71) Applicant: Travel Tags, Inc., North Mankato, MN (US)

(72) Inventors: Shelle B Pascua, Sherwood, OR (US); Deborah Bartles, Vancouver, WA (US); John Tomczyk, Shoreview, MN (US)

(73) Assignee: Travel Tags, Inc., North Mankato, MN (US)

( * ) Notice: Subject to any disclaimer, the term of this patent is extended or adjusted under 35 U.S.C. 154(b) by 0 days.

(21) Appl. No.: 15/711,766

(22) Filed: Sep. 21, 2017

(65) Prior Publication Data

US 2018/0079248 A1 Mar. 22, 2018

Related U.S. Application Data

(60) Provisional application No. 62/397,907, filed on Sep. 21, 2016, provisional application No. 62/406,319, filed on Oct. 10, 2016, provisional application No. 62/491,422, filed on Apr. 28, 2017.

(51) Int. Cl.

| | |
|---|---|
| ***B42D 25/20*** | (2014.01) |
| ***B42D 15/04*** | (2006.01) |
| ***B42D 25/369*** | (2014.01) |
| ***B65D 85/00*** | (2006.01) |
| ***B42D 25/22*** | (2014.01) |

(52) U.S. Cl.

CPC ..... *B42D 25/20* (2014.10); *B42D 15/045* (2013.01); *B42D 25/22* (2014.10); *B42D 25/285* (2014.10); *B42D 25/369* (2014.10); *B65D 85/00* (2013.01)

(58) Field of Classification Search

CPC ..... B65D 27/30; B65D 85/00; B42D 25/20; B42D 25/22; B42D 25/285; B42D 25/369; B42D 15/045

See application file for complete search history.

(56) References Cited

U.S. PATENT DOCUMENTS

| | | | | |
|---|---|---|---|---|
| 2,130,488 A * | 9/1938 | Funk | ..... | B65D 5/445 229/122.32 |
| 2,496,856 A * | 2/1950 | Cook, Jr. | ..... | B41M 5/10 462/69 |
| 3,086,692 A * | 4/1963 | Cage | ..... | B65D 5/5445 229/101.1 |
| 3,288,281 A | 11/1966 | Sparks | | |

(Continued)

OTHER PUBLICATIONS

SlingShot CD Package, 2 pages, c. 2000.

(Continued)

*Primary Examiner* — David R Dunn
*Assistant Examiner* — Christopher E Veraa
(74) *Attorney, Agent, or Firm* — Patterson Thuente Pedersen, P.A.

(57) ABSTRACT

A secure packaging system for a stored value card. The secure packaging system including a front panel and a back panel sealed via a non-rewettable polymer to the front panel at a non-rewettable sealing section, the sealing section arranged continuously around at least a periphery of the stored value card, wherein the sealing section cannot be reactivated or unsealed with heat to access the contents therein.

22 Claims, 16 Drawing Sheets

(56) References Cited

U.S. PATENT DOCUMENTS 3,409,206 A * 11/1968 Slouka ..... B31B 50/00 229/201
3,773,251 A 1/1973 Hadick
4,939,992 A 7/1990 Bird
5,275,285 A 1/1994 Clegg
5,419,433 A 5/1995 Harrer et al.
5,489,123 A 2/1996 Roshkoff
5,493,801 A 2/1996 James
5,544,741 A 8/1996 Fantone et al.
5,588,526 A 12/1996 Fantone et al.
5,609,253 A 3/1997 Goade, Sr.
5,650,209 A 7/1997 Ramsburg et al.
5,660,925 A 8/1997 Cooley et al.
5,760,381 A 6/1998 Stitch et al.
5,782,347 A 7/1998 Fantone et al.
5,791,474 A 8/1998 Hansen
5,833,068 A 11/1998 Fantone
5,850,913 A 12/1998 Fantone et al.
5,851,630 A 12/1998 Davis, II
5,918,909 A 7/1999 Fiala et al.
5,941,382 A 8/1999 Fantone et al.
5,975,302 A 11/1999 Young
6,109,439 A * 8/2000 Goade, Sr. ..... B32B 37/185 206/37
6,145,665 A 11/2000 Krahn
6,179,119 B1 1/2001 Manoogian
6,224,108 B1 5/2001 Klure
6,245,382 B1 6/2001 Shvartsman et al.
6,253,820 B1 7/2001 Landan et al.
6,286,999 B1 9/2001 Cappel et al.
6,328,341 B2 12/2001 Klure
6,349,928 B1 2/2002 Matheis et al.
6,439,613 B2 8/2002 Klure
6,454,165 B1 9/2002 Dawson
6,481,994 B1 11/2002 McCannel et al.
6,520,329 B1 2/2003 Fuchs
6,543,809 B1 4/2003 Kistner et al.
6,588,591 B1 7/2003 Schabert et al.
6,601,415 B2 8/2003 Takinami
6,640,974 B2 11/2003 Malone
6,715,795 B2 4/2004 Klure
6,957,737 B1 10/2005 Frederickson et al.
6,964,810 B2 11/2005 McCannel et al.
7,117,512 B1 10/2006 Cahill
7,219,829 B2 5/2007 Treat
7,222,797 B2 5/2007 Davilla et al.
7,300,535 B2 11/2007 McCannel et al.
7,441,776 B2 * 10/2008 Ustarbowski ..... A63F 9/0613 273/153 R
7,537,168 B2 5/2009 Anderson et al.
7,658,282 B2 2/2010 Costel
7,681,732 B2 3/2010 Moehlenbrock et al.
7,726,477 B1 6/2010 Gaither
8,292,072 B2 * 10/2012 Corey ..... B42D 15/085 206/311
8,419,889 B2 4/2013 Smith
8,617,673 B1 * 12/2013 Desai ..... B32B 27/08 428/34.1
8,807,332 B1 8/2014 Pascua et al.
8,833,553 B2 9/2014 Corey et al.
2002/0088855 A1 7/2002 Hodes
2002/0157973 A1 10/2002 Preisler
2003/0004889 A1 1/2003 Fiala et al.
2003/0018586 A1 1/2003 Krahn
2003/0028439 A1 2/2003 Cox
2003/0080013 A1 5/2003 Smith
2003/0150762 A1 8/2003 Biller
2003/0234191 A1 12/2003 Belden, Jr. et al.
2004/0008613 A1 1/2004 Beckwith et al.
2004/0151880 A1 8/2004 Nakamura et al.
2005/0045503 A1 3/2005 Wong et al.
2005/0045732 A1 3/2005 Whitaker
2005/0061759 A1 * 3/2005 Doucette ..... B65D 75/367 211/85.4
2005/0199516 A1 9/2005 Laarman
2005/0205442 A1 9/2005 Spagna
2005/0279143 A1 12/2005 Belden, Jr. et al.
2005/0279825 A1 12/2005 Ashby et al.
2006/0207896 A1 9/2006 Shiga
2006/0256413 A1 11/2006 Kitamura
2007/0144044 A1 6/2007 Kershner et al.
2007/0278114 A1 12/2007 Kane et al.
2008/0030864 A1 2/2008 Gougeon et al.
2008/0088126 A1 4/2008 Hoffman
2008/0088931 A1 4/2008 Hoffman
2008/0116089 A1 5/2008 Roberts
2008/0150174 A1 6/2008 Raymond et al.
2008/0213528 A1 9/2008 Hoffman
2009/0078590 A1 * 3/2009 Smith ..... B65D 75/26 206/39
2009/0107862 A1 * 4/2009 Pascua ..... B65D 75/14 206/232
2009/0277808 A1 11/2009 Payne
2010/0193583 A1 8/2010 Tartavull et al.
2010/0213092 A1 8/2010 Swain
2010/0285398 A1 11/2010 Hogerton et al.
2010/0326011 A1 * 12/2010 Norling ..... B27D 1/04 52/796.1
2011/0031148 A1 2/2011 Rosendall et al.
2011/0132783 A1 6/2011 Williams et al.
2012/0145578 A1 6/2012 Pazlar et al.
2012/0256006 A1 * 10/2012 Schmitt ..... B65D 75/28 235/493
2012/0280043 A1 11/2012 Roseman
2013/0068642 A1 3/2013 Corey et al.
2014/0262872 A1 * 9/2014 Helm ..... G11B 33/0427 206/308.1
2015/0353237 A1 * 12/2015 Haedt ..... B65D 75/5805 383/207
2016/0005031 A1 1/2016 O'Regan et al.
2016/0031624 A1 * 2/2016 Pascua ..... B32B 7/12 206/459.1
2016/0332789 A1 11/2016 Yerecic
2017/0243098 A1 8/2017 Pascua et al.
2017/0323191 A1 11/2017 Pascua et al.

OTHER PUBLICATIONS

Introducing RiverBorne™ Communications, 17 pages, c. 2000.
Printout of various lenticular packaging options, 3 pages, at least as of Nov. 13, 2009.
Application and File history for U.S. Appl. No. 14/813,940, filed Jul. 30, 2015. Inventors: Shelle B. Pascua et al.
Application and File history for U.S. Appl. No. 12/962,344, filed Dec. 7, 2010. Inventors: David L. Williams et al.

* cited by examiner

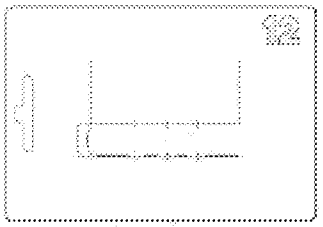
FIG. 8A
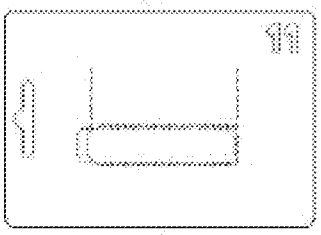
FIG. 8B
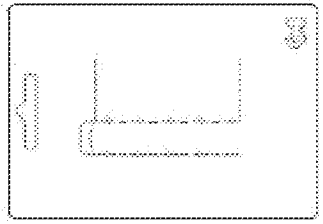
FIG. 8C
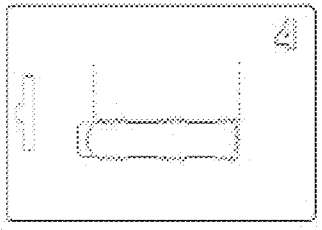
FIG. 8D
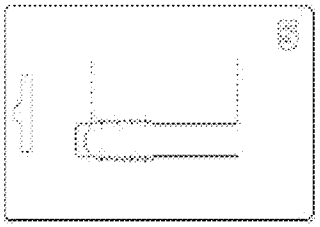
FIG. 8E
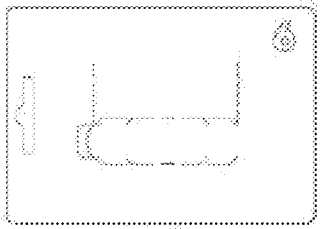
FIG. 8F
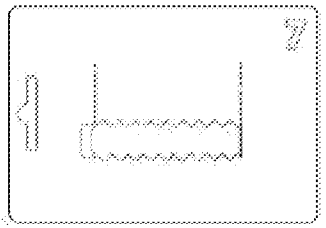
FIG. 8G
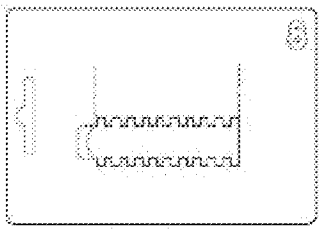
FIG. 8H
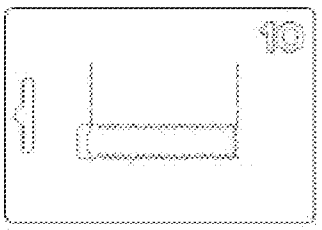
FIG. 8I
FIG. 8J
FIG. 8K

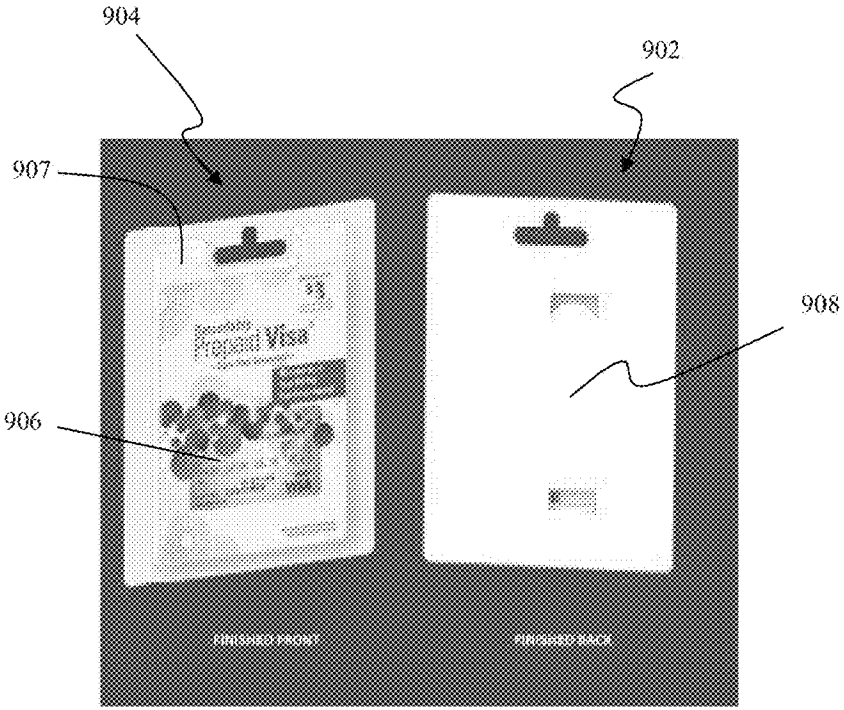
FIG. 9B
FIG. 9C
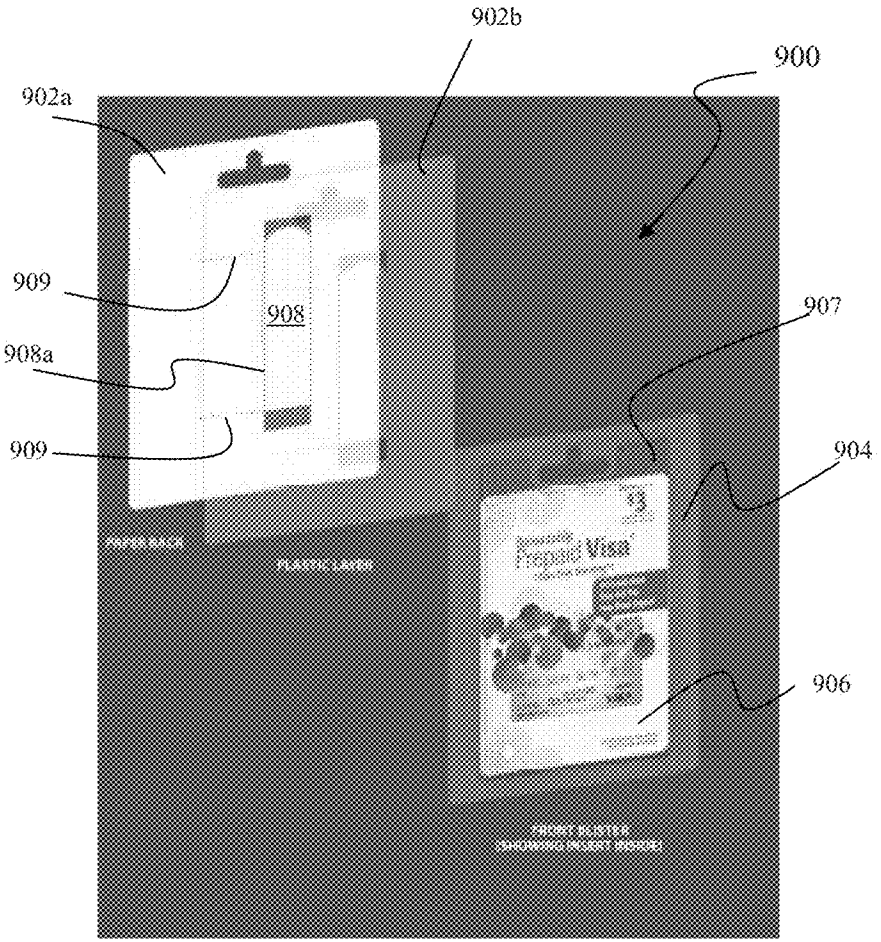
FIG. 9A

SECURE PACKS FOR TRANSACTION CARDS

RELATED APPLICATION INFORMATION

The present application claims the benefit of U.S. Provisional Application No. 62/397,907 filed Sep. 21, 2016, U.S. Provisional Application No. 62/406,319 filed Oct. 10, 2016, and U.S. Provisional Application No. 62/491,422 filed Apr. 28, 2017, each of which is hereby incorporated in its entirety by reference.

TECHNICAL FIELD

This application relates generally to stored value cards, and more particularly relates to a system used for securing activation data within a secure package, the assembly being configured to conceal activation data of stored value cards with packaging that is to be removed upon purchase.

BACKGROUND

Stored value cards, which may also be known as gift cards, prepaid cards, shopping cards or fare cards, prepaid Mastercard™ and Visa™ cards (instant issue) among other names, are very popular with both consumers and retailers. The wide appeal of stored value cards, as a result, has attracted the unwelcome attention of criminals seeking to exploit the conveniences and automated processes afforded by such cards. In particular, such criminals misappropriate and manipulate stored value cards and associated account information to perform fraudulent transactions. Stored value card fraud is typically perpetrated in the form of either physical point of sale (POS) or "card present" fraud, or for virtual POS purchases or "card not present" (CNP) fraud. The latter includes transactions such as e-commerce or internet purchases that cannot be authenticated using "standard" processes used at the physical POS.

A stored value card is typically the size and shape of a conventional credit card (CR80 Card) and includes a magnetic stripe, barcode or other similar activation method, account identifying element, or means for using the card. The stripe, code, account identifying element, etc. on the card is encoded with data, which includes a unique account number. The account activation indicia, for example, may be visible while the card is secured in or secured to packaging, such that the account activation indicia may be used during the purchase and activation of the card.

Commonly, stored value cards are displayed by retailers for purchase by customers. The cards may be stored in an active or inactive state. If stored in an inactive state, the card cannot be used to purchase goods or services until the card has been activated. A customer may have a card activated by bringing a card to a cashier and having the cashier then, for example, swipe the card through a point of sale terminal, which may add value to the card in exchange for payment, or activate value already on the card. In this context, the "swipe" action could involve passing a card (or its packaging) through a magnetic strip reader/writer; or passing the card or package over a barcode scanner; or putting the card or package in the vicinity of a proximity reader/writer (such as, for example, an RFID reader/writer), or any other equivalent activation technique. A balance on the card may be maintained within a computer system located at the point of sale or at a remote location. A holder of the stored value card may then use the card to purchase goods and/or services immediately or over time up to the value of the card. These current procedures relating to stored value cards, although providing convenience to consumers, leave the cards vulnerable to criminals.

One particular fraud that is perpetuated by criminals with regard to stored value cards is called "skimming." Skimming is a serious problem resulting in significant loss to both retailers and consumers, and applies to both card present and CNP fraud. To skim a card having a magnetic stripe holding account information, for example, a criminal will purchase a stored value card from a retailer, thereby causing an account associated with the card to become activated. The criminal will then remove additional cards from the store that have not yet been activated, and will then magnetically alter stored information on the inactivated cards to match that of the activated card. As such, all of the altered, inactivated cards will have the magnetic information that identifies the account of the originally purchased card. The criminal will then return the altered cards to the store shelf where unsuspecting customers seeking to purchase a stored value card will unknowingly place money into the account of the criminal holding the originally purchased card. The unsuspecting customer may attempt to use their card and will be told that it has no associated value or has a smaller value than thought. The retailer may be able to verify that the customer did not use the value associated with the stored value card, and in the interest of customer service, may restore the value to the customer. In that case, the retailer loses the money. However, in some cases, there may be no way to prove fraud and the customer may lose up to the entire value.

Another type of fraud that is perpetrated by criminals with regard to stored value cards is unauthorized activation. Specifically with secure packaging, activation indicia, such as a barcode, is printed on the card, often positioned beneath a perforated pull tab. Account information, such as a PIN or account number, is also on the card and is typically sealed within package. Fraud is perpetrated when a criminal takes a stored value package from a retailer without purchasing the card. The criminal then carefully removes the card from the package, and steals account information from the card. The criminal then either replaces the card within the package or places another card with an activation barcode in the package, and carefully reseals the pack. The criminal then re-hangs or replaces the package at the retailer location, and waits until package is sold by visually checking if pack is still on rack or by attempting to check balance online. An unsuspecting customer then purchases the package and activates the stored value card, thereby unknowingly placing money into the account associated with the stolen card that is in the criminal's position or for which the criminal has access to the original account information. When the unsuspecting customer attempts to use their card, they will find that the card has no associated value or has a smaller value than thought.

Another similar type of unauthorized activation is also perpetrated with regard to stored value cards. As above, activation indicia, such as a barcode, is printed on the card and often positioned beneath a perforated pull tab. Account information, such as a PIN or account number, is also on the card and is typically sealed within the package. Fraud is perpetrated when a criminal takes two stored value packages from a retailer without purchasing either. The criminal will then carefully open each pack and copies the activation barcode from a first card of the first package and places the data, by some means, onto to a second card of the second package, and then carefully reseals the second package. The criminal then re-hangs or replaces the second package at the retailer location, then waits until the second package is sold by visually checking if pack is still on rack or by attempting to check balance online for the first card. An unsuspecting customer then purchases the second package and unknowingly activates the stored value card of the first package, thereby unknowingly placing money into the account of the criminal holding the first card. When the unsuspecting customer attempts to use the second card, they will find that the card has no associated value or has a smaller value than thought.

Another fraud perpetuated by criminals is carried out by a criminal viewing stored value cards in the store. Fraud is perpetuated when a criminal copies a code associated with the particular stored value card (such as a credit card type number) while it is still in the store. Often, in such situations the code is in plain view of the criminal, or may be easily viewed without altering the card packaging. Once the criminal has the copied code, the criminal waits for a period of time, with the assumption that an unsuspecting customer will purchase and activate the card during that time. The criminal then periodically checks to see if they are able to make purchases, such as online purchases (CNP fraud), by attempting to use the card code. If the card has been activated by the true purchaser, the criminal will be able to purchase goods online using the activated code, thereby stealing the balance on the card from the true purchaser.

Criminals may perpetuate the above-described frauds or other frauds with regard to stored value cards as they sit on store shelves today. Thus, there is a need for a way to protect such cards and insure that they have not been tampered with or duplicated prior to purchase and/or activation by an innocent consumer.

There have been proposals and attempts to reduce the occurrence of fraud associated with stored value cards. For example, modifications to card readers or other parts of the activation process have been proposed, but changing existing hardware systems in such ways involves significant cost. Additional steps have been added to the activation process for some cards, such as steps involving pin numbers and web access. However, additional steps reduce the level of convenience that such cards provide to consumers.

Other attempts at reducing the occurrence of fraud include packaging of the card such that unauthorized tampering with the packaging or card therein is visually evident. Examples of these types of secure packs can include, for example, sealing the card, sensitive information concerning the card, or combinations thereof within a single or multi-panel carrier such that a breach of the package destroys the carrier. However, these packages have been vulnerable to breach by the use of a sharp instrument, such as a razor blade, to slice open the package at its sealed edge and/or by using a heating device, such as a source of dry heat or steam, to open the heat sealed pack. The card and/or information are then accessed for skimming purposes, and the package is resealed, without evidence that it has been compromised.

Therefore, there remains a need for a way to prevent fraud relating to stored value cards that is effective, and inexpensive to implement, while at the same time not negating the convenience of stored value cards.

SUMMARY

Embodiments of the present disclosure provide a stored value card and carrier assembly including tamper evident packaging and related methods. The secure packaging system can include one or more discrete or foldable panels, that are sealed around a stored value card and optional carrier. The one or more panels can be sealed together via non-rewettable seal that is wide enough such that an initial opening of the package through the seal is evident. A "non-rewettable seal" for the purposes of this application can include a heat or ultrasonic seal in which the polymer material melts to itself (or other compatible polymer material), and when heated, will not reopen the bond. Alternatively, one or more layers of permanent adhesive can be applied to one or more of the panels for additional bonding of the panels together.

In embodiments, the non-rewettable polymer material can comprise amorphous polyethylene terephthalate (APET), polyethylene terephthalate glycol-modified (PETG), polycarbonate, or combinations thereof, and can be clear, opaque (color or white), semi-opaque (color or white), or combinations thereof.

In embodiments, the panels can be made from one of the following constructions: (1) paper with a non-rewettable polymer material layer or insert mounted to the inside of the panel; (2) the entire panel is made from the non-rewettable polymer material; and/or (3) a synthetic material, such as another polymeric material, with the non-rewettable polymer material layer or insert mounted to the inside of the panel. Further, the non-rewettable layer or panel can be clear, opaque (white or colored), or semi-opaque (white or colored). The inner and/or outer layers or surfaces of the panels can printed, decorated, embellished, or otherwise adorned by any of a variety of means including, but not limited to, conventional and/or digital printing, metallization, foil lamination, foil stamping, embossing, and/or screen printing. One or more of the panels can be planar, texture, and/or can comprise a blister, such as a thermoformed blister or other window, for viewing the contents within the carrier assembly. In embodiments, a lens array, such as a lenticular or fly's eye lens array can be incorporated into, either by laminating or forming thereon, one or both panels with associated imaging.

In embodiments in which the panels comprise paper with a non-rewettable polymer material layer or insert mounted to the inside of the panel, a grain orientation of one panel is different than a grain orientation of the other panel to reduce or prevent curling of the assembly once sealed. For example, the orientation of the grain of the first panel can be perpendicular to the grain of the second panel to offset the forces on the assembly due to shrinking upon heat sealing, thereby reducing or eliminating curl.

In some embodiments, the secured packaging system can include a tear or pull tab that, once peeled back or entirely torn away, reveals activation data for the stored value card for use in activation by a cashier or end-user. Once the tear or pull tab is pulled back or separated from the carrier assembly altogether, the tamper evident packaging shows evidence of tampering, thereby making fraudulent access detectable.

In some embodiments, the tab can be formed having a longitudinal axis parallel to a grain of the paper, such that minimal or no perforations or kiss cuts are required in the panel to pull the pull tab back. In some embodiments, a polymeric label is adhered to the pull tab on an interior surface of the panel. The label reinforces the pull tab, while providing evidence of package breach. In one embodiment, the label is dimensioned similar to the dimensions of the pull tab. In another embodiment, the label includes one or more extension flaps, extending from the one or both long edges of the label such that it adheres not only to the pull tab, but beyond the pull tab on the inner surface of the panel to reinforce an area of the panel around the pull tab. The pull tab extension flaps can include scoring, perforations, and/or kiss cuts dimension in accordance with the pull tab such that the label separates from the extension flaps and remains adhered to the pull tab when the pull tab is separated. The panels can optionally further include a perforated edge that is meant and ruptured by the user and the stored value card and carrier can then be removed easily. Alternatively to the perforated edge, a tear strip can be added to at least one of the panels for pulling and access to the card inside. In an embodiment, the tear tab is kiss cut on an interior facing side of the panel such that it is not visible from the exterior of the packaging. However, the kiss cut is deep enough that once the tab is pulled, the kiss cut creates a track for the package to rupture along in a controlled manner, and indicating tampering.

The heat sealable panels can optionally further include a perforated edge that is bent and ruptured by the user and the stored value card and carrier can then be removed easily. Alternatively to the perforated edge, a tear strip or pull tab can be added to at least one of the panels for pulling and access to the card inside. In embodiments in which a tab is present, the tab can be formed of perforations, and/or die or kiss cuts or scores, extending either partly or entirely through the non-rewettable polymer layer. In other embodiments, no pull tab is present and the user can cut, tear or otherwise access the package for activation.

In an embodiment, if the non-rewettable polymer material is laminated to one of the panels, it can be flood or completely laminated, or spot laminated in areas. In one non-limiting example in which a pull or tear tab is present, it may be desirable to heat seal the panels around a perimeter of the carrier and not around the pull tab area. In other words, it may be desirable for a clear non-rewettable polymer material to remain intact under the pull tab area and not pulled up with the pull tab, thus adding extra protection to activation barcode or other indicia. Further the back panel can optionally include diecut areas before lamination to define portions of where the back panel is missing. In these embodiments, additional reinforcing means can be applied over the pull tab area. For example, a label may be applied inside of a paper panel or onto the back of the carrier, such that, when removed, tampering is evident. In another example, the pull tab area may be printed or otherwise coated with a reinforcing material, such as a rubberized coating, which when the pull tab is pulled back, the coating is destroyed and tampering is evident.

In another embodiment, an inner sheet of non-rewettable polymer layer is placed between each heat sealable panel and the stored value card and carrier combination. The inner sheets of non-rewettable polymer layer heat seal to each other and bond to the front and back panels and to each other. Alternatively, one or more layers of permanent adhesive applied to the front panel and/or back panel can be used to further bond the front and back panels. When the user wishes to access the activation data, the pull tab or tear strip must be pulled back (or alternatively removed), the inner sheet of non-rewettable polymer layer that is bonded to the back panel is torn open, further showing the breach of the package. The inner sheets could be made of thin laminated non-rewettable polymer layer such that removal of the tear tab does not become too difficult.

In an alternative embodiment, the back panel with a layer of non-rewettable polymer material mounted to an inside surface is thick enough to have a tear tab and/or perforations to induce and guide tearing. The back panel has adjoining tear tab cut outs, but does not have perforations. The back non-rewettable polymer layer is made of an easily tearing material. In this embodiment, the user accesses the activation data by gripping the tear tab feature that is present on both the back panel and the back inner sheet and pulls the tear tab away. The tear tab tears along the perforations or kiss cuts present in the non-rewettable polymer layer and tears the un-perforated back panel leaving obvious evidence of tear tab removal or tampering. The back panel non-rewettable polymer layer material must tear with less force than the force needed to tear the perforated inner back sheet in order for both the inner back sheet and the back panel to tear at the appropriate spot. In this embodiment, a heat sealable front panel with non-rewettable polymer layer is used to cover the other side of the stored value card and carrier combination.

In some embodiments in which a pull tab is present on a paper carrier, a pull tab area on the back panel can be reinforced by means of a clear layer adhered around the paper pull tab window area, to further protect the card activation barcode from direct access, yet the activation barcode, or other activation indicia, can be read and activated through the clear layer.

In an alternative embodiment, a nonrenewable polymeric insert or layer, such as a sheet of PETG, is adhered to an inner surface of the one or more panels, such as by adhesive, heat sealing, or other adhering means. The polymeric insert can include scoring, perforations, and/or kiss cuts dimensioned in accordance with the pull tab areas such that the tab portion of the polymeric insert separates from the polymeric insert and remains adhered to the pull tab when the pull tab is pulled back. In this embodiment, when the cashier or user wishes to access the activation data, the pull tab must be pulled back (or alternatively removed altogether), and the polymeric insert that is bonded to the inner surface of the carrier is irreversibly torn open, thereby showing the breach of the package.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which:

FIGS. 8A-K depict various score patterns for forming a tamper evident pull tab in a panel of a secure package, according to various embodiments of the disclosure.

FIG. 9A is an exploded, perspective view depicting the secure package assembly for stored value cards in accordance with the eighth embodiment of the disclosure.

FIG. 9B is a front perspective view of the secure package assembly of FIG. 9A.

FIG. 9C is a rear perspective view of the secure package assembly of FIG. 9A.

Figure 1B:
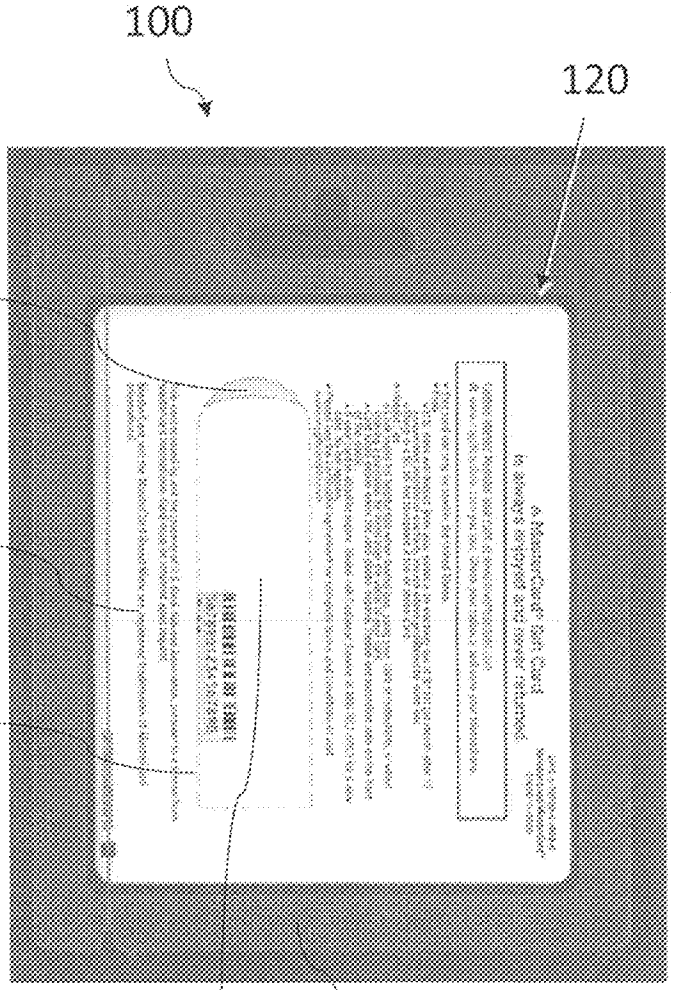
FIG. 1B is a rear perspective view of the secure package assembly of FIG. 1A.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

The embodiments described below are not intended to be exhaustive or to limit the invention to the precise forms disclosed in the following detailed description. Rather the embodiments are chosen and described so that others skilled in the art may appreciate and understand the entire disclosure.

Figure 1A:
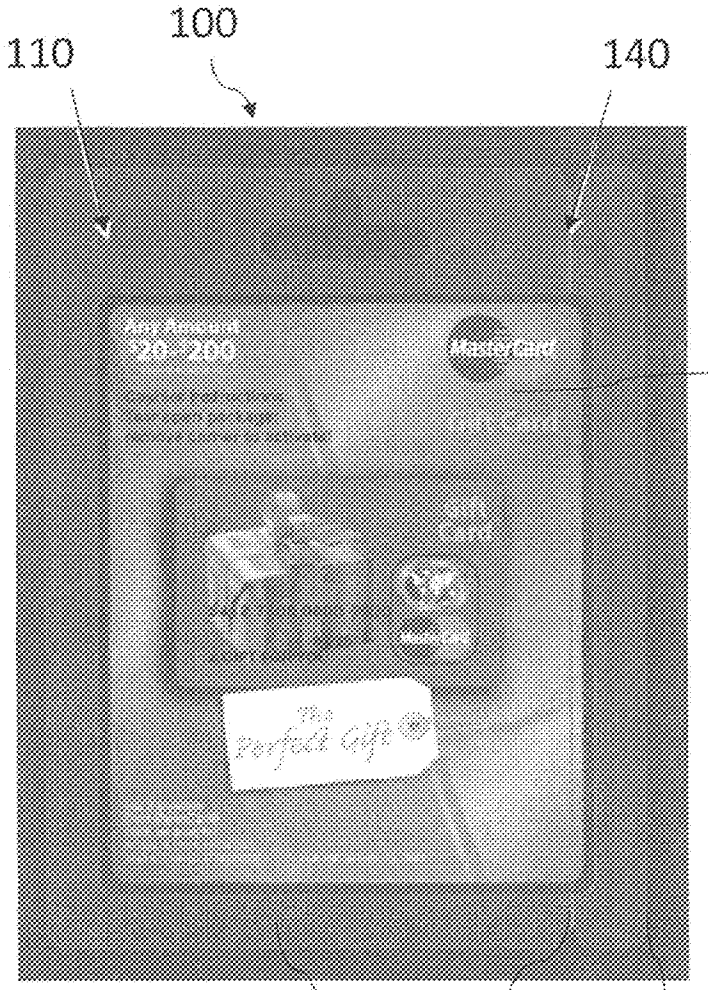
FIG. 1A is a front perspective view depicting a secure package assembly for stored value cards in accordance with a first embodiment of the disclosure.

Referring to FIGS. 1A and 1B, front and rear views of a secure pack 100 securing a stored value card (not shown) enclosed in a carrier 104 are depicted. Secure pack 100 comprises a front panel 110 (as depicted in FIG. 1A) and a back panel 120 (as depicted in FIG. 1B). Front panel 110 and back panel 120 are configured to heat seal together at sealing area 130 after the card and carrier 104 are placed between front panel 110 and back panel 120. Front panel 110 and back panel 120 can be made of amorphous polyethylene terephthalate (APET), polyethylene terephthalate glycol-modified (PETG), or other plastic or non-rewettable polymer layer material suitable for heat sealing processes. Front panel 110 and back panels 120 can have thicknesses between approximately 6 mil and 12 mil. Front panel 110 and back panel 120, in this and other embodiments, can be transparent, translucent, opaque, in any hue of color, including white, and/or any combination thereof. For example, front panel 110 can be transparent, while back panel 120 can be opaque via a filler material, the polymeric material, and/or by flood coat printing.

After heat sealing, sealing area 130 comprises a melted and distorted interface between components of the same material resulting in a seal that cannot be separated cleanly. Secure pack 100 can also include a break edge 140, which further includes a perforated line 142 that is offset slightly from an edge 144 of secure pack 100. In an alternative embodiment, other mechanism for removing the card and carrier 104 are contemplated, such as a tear tag, rip notch or other suitable package removal features.

The back panel 120 of carrier 104 can further comprise a tear tag or pull tab 150 that is located over and obscures the activation data of the card. Pull tab 150 can further comprise a half-moon cut-out 152 and a tag perforation 154; however, half-moon cutout 152 and tag perforation 154 are not essential elements in this or other embodiments. Pull tab 150 features are created by a die-cut process, or other suitable material removal process. Half-moon cut-out 152 can be configured to allow the user to pry up a graspable portion of pull tab 150 and separate pull tab 150 away from carrier 104 by tearing at perforation 154.

Figure 2:
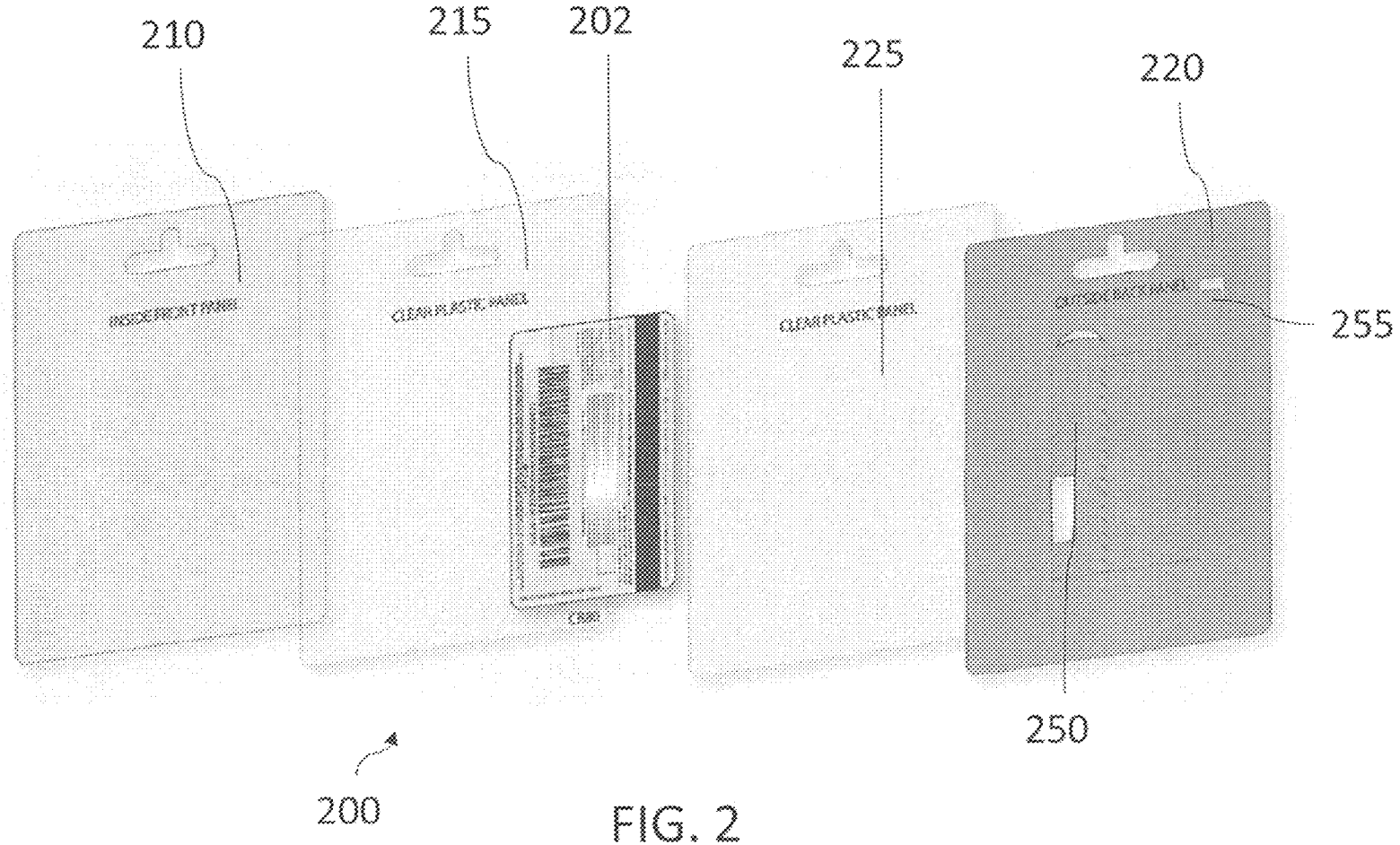
FIG. 2 is an exploded view depicting a secure package assembly for stored value cards in accordance with a second embodiment of the disclosure.

Referring to FIG. 2, in another embodiment, secure pack 200 includes a stored value card 202, a front panel 210, front inside sheet 215, back panel 220, and back inside sheet 225. In embodiments, front inside sheet 215 and back inside sheet 225 are made of relatively thin APET, PETG, or other suitable material as listed above, which when heat sealed together, create an encapsulation of card 202 that must be torn to access stored value card 202. Back panel 220 can be transparent, translucent, opaque and in any hue of color. Back panel 220 includes a pull tab 250 which again obscures the activation data of card 202. Back panel 220 also includes a card access tag 255, which can be grasped and torn away in similar fashion to pull tab 250. In embodiments, inside sheets 215 and 225 are bonded to respective panels 210 and 220 either passively during the final heat sealing process, by a suitable adhesive, or by individual lamination wherein sheets 215 and 225 are laminated to panels 210 and 220 separately before the final heat seal process. When either pull tab 250 or card access tag 255 is torn away from back panel 220, the corresponding portion of rear inside sheet 225 is torn away leaving visible evidence of the opening of secure pack 220. In an alternative embodiment, other mechanisms for removing card 202 from pack 200 are contemplated, such as various tear tags, rip notches, or other suitable package removal features.

Figure 3B:
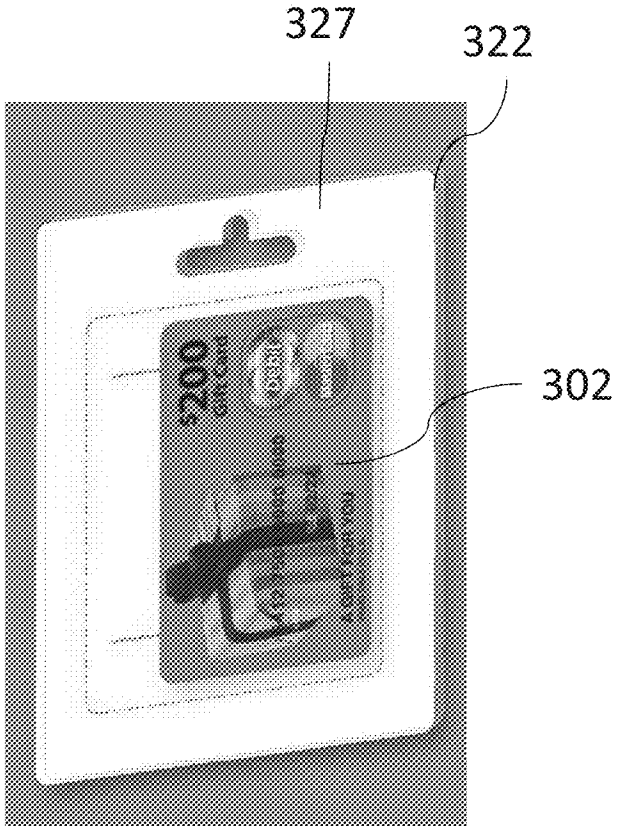
FIG. 3B is a perspective view depicting a rear component of secure package assembly of FIG. 3A in an assembled form.

Referring to FIG. 3A-D, in another embodiment, secure pack 300 includes a stored value card 302, front panel (not shown), back laminate panel 322, and back tear panel 327. The back laminate panel 322 and back tear panel 327 are heat sealed around card 302 such that card 302 can be secured between back laminate panel 322 and the front panel. In embodiments, mechanisms for removing card 302 from the carrier are contemplated, such as various tear tags, rip notches or other suitable package removal features. Either during the final heat seal process or in a preliminary process, back laminate panel 322 and back tear panel 327 can be bonded together by lamination, adhesive or other suitable process (as depicted in FIG. 3B). Back laminate panel 322 and back tear panel 327 can be transparent, translucent, opaque, and in any hue of color. The combination of back laminate panel 322 and back tear panel 327 can have a thickness between approximately 6 mil and 12 mil.

Figure 3A:
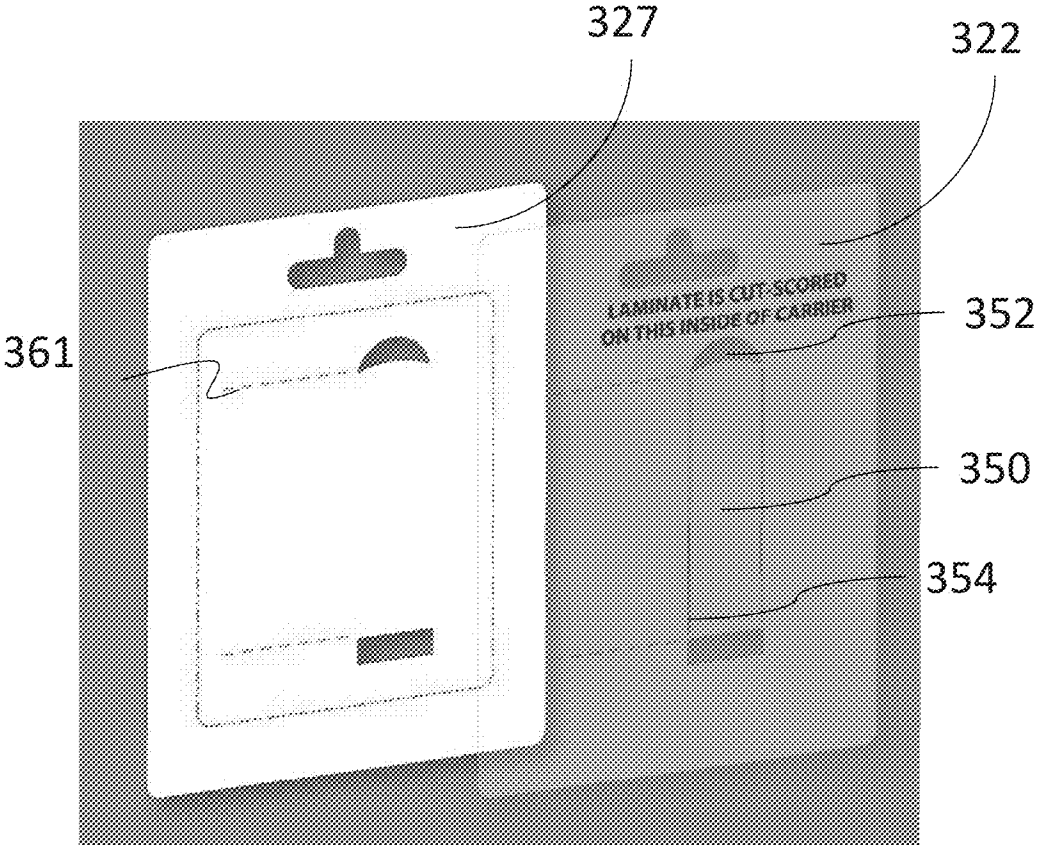
FIG. 3A is an exploded, perspective view depicting a rear component of a secure package assembly in accordance with a third embodiment of the disclosure.

With reference to FIG. 3A, back laminate panel 322 can include a pull tab 350 arranged adjacent to the activation data of card 302. Pull tab 350 can further comprise a half-moon cut-out 352 and a tag perforation 354. Back laminate panel 322 can be made from APET, PETG, or other suitable plastic at a thickness that strikes a balance between strength and ease of opening.

With reference to FIGS. 3A-3D, back tear panel 327 can include a back tear cut-out portion 360 arranged adjacent to pull tab 350, so as to obscure the activation data of card 302. Back tear panel 327 can be made of easily tearing material such as paper, cardboard or other suitable material. Notably, back tear cut out portion 360 need not include any perforations, and may only include kiss cuts, for examples for providing a pathway for opening.

Figure 3D:
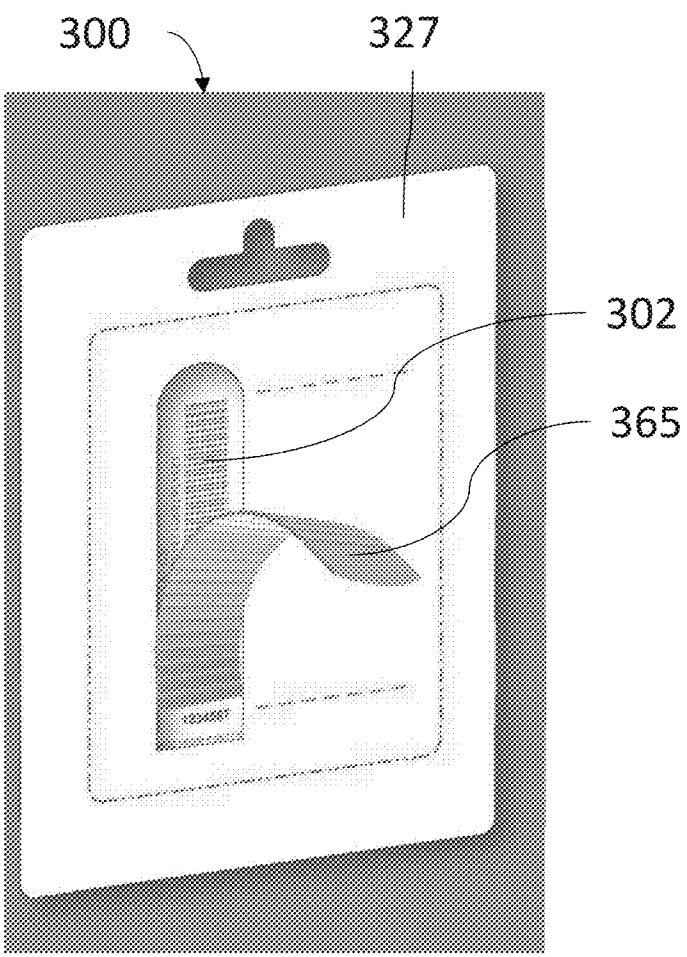
FIG. 3D is a rear perspective view depicting the secure package assembly of FIG. 3C, with a tear tab partially removed.
Figure 3C:
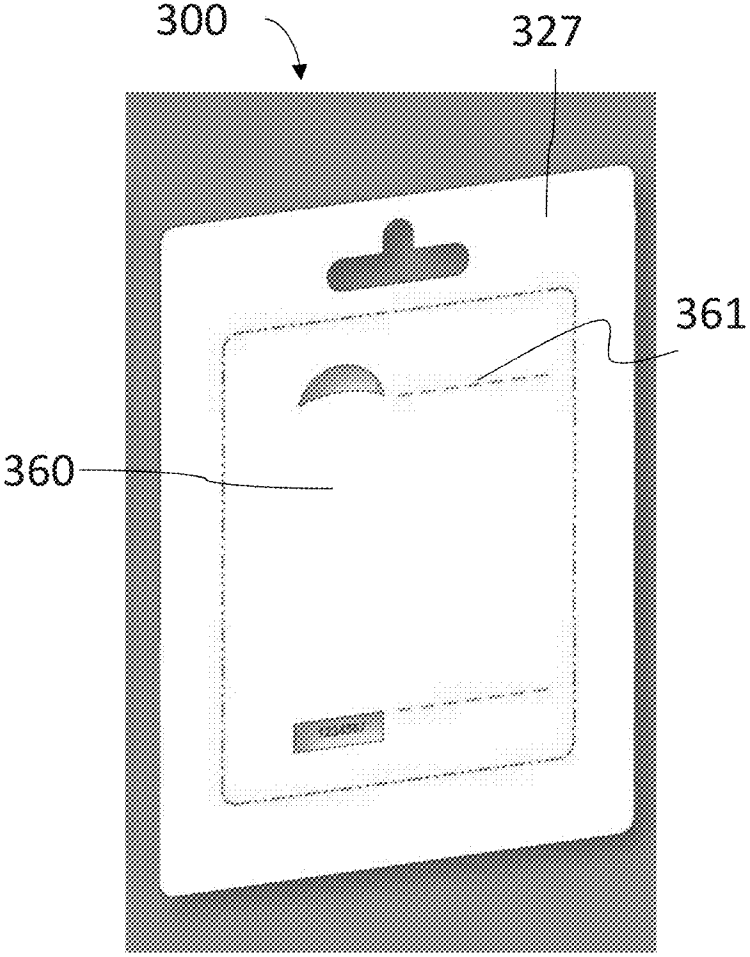
FIG. 3C is a rear perspective view depicting the secure package assembly of FIG. 3A.

In use, a user grasps the bonded pull tab 365 (as depicted in FIG. 3D), which includes laminate panel pull tab 350 (shown in FIG. 3A) and back tear cut out portion 360 (shown in FIG. 3C). The user then removes bonded pull tab 365 and thus simultaneously removing pull tab 350 and back tear cut out 360, as prescribed by tag perforation 354 in back laminate panel 322 and optional kiss cuts (not shown) in back tear panel 327. If the force necessary to tear the material of back tear panel 327 is less than the force needed to tear the material of back structure panel 322 at a perforation line, bonded pull tab 365 will tear along a path adjacent to tag perforation 354, which may be further aided by kiss cuts (not shown) formed in panel 327. The result is a visible and irreparably torn edge around bonded pull tab 365 and the related torn edge of back tear panel 327. In an alternative embodiment, back structure panel 322 can be replaced by a reinforced tear strip adjacent to back tear cut out portion 360, such that when opening, the bonded pull tab 350 assumes the shape of the reinforced tear strip.

Referring to FIGS. 3A-3D, additional perforations 361 formed in panel 327 can be formed in tear panel 327 to aid in removal of card 302 from pack 300 once pull tab 365 has been removed.

Figures 4A, 4B:
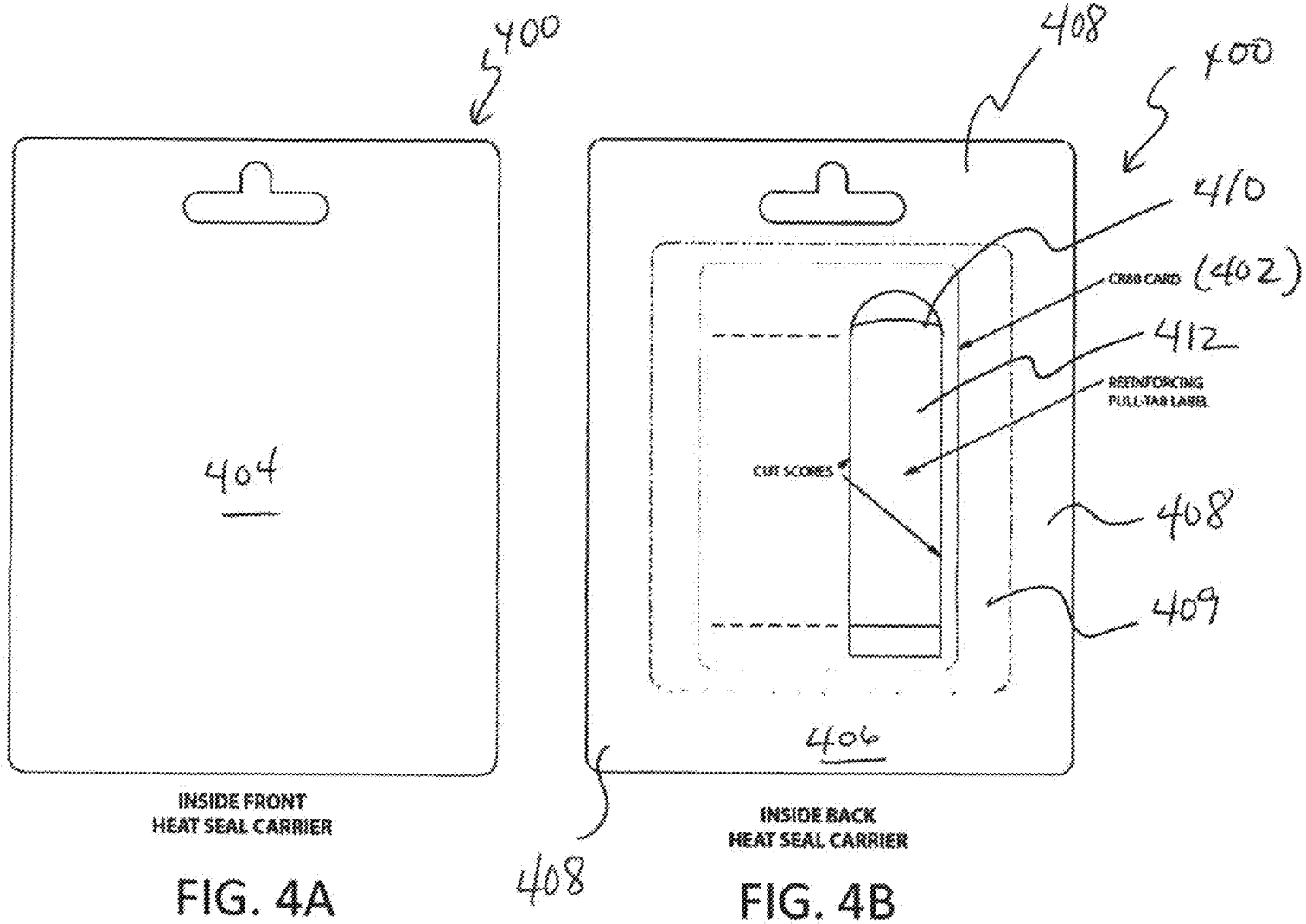
FIG. 4A is a front perspective view depicting a secure package assembly for stored value cards in accordance with a fourth embodiment of the disclosure.
FIG. 4B is a rear perspective view depicting the secure package assembly of FIG. 4A.

Referring to FIGS. 4A-B, and another embodiment, secure pack 400 includes a stored value card 402, front panel 404 (as depicted in FIG. 4A), and back panel 406 (as depicted in FIG. 4B). Front panel 404 and back panels 406 can comprise any of the materials described above, including a paper or polymer panel with or without a non-rewettable polymer layer (not shown) laminated thereto. In one embodiment, panels 404, 406 are sealed only around sealing section 408. A pull tab 410 can be defined with back panel 406 by perforations, cut scores, or any of a variety of scoring or cutting techniques. A reinforcing label 412 can be laminated, adhered, or otherwise bonded to an inner surface of back panel 406 in a non-sealed portion 409 before panels 404, 406 are sealed together, so as to provide stability to back panel 406. Label 412 can be sized similarly to tab 410 or can be sized larger than tab 410 to extend over edges of tab 410. Label 412 can optionally include perforations or scoring mirroring tear tab 410 to aid in peeling tab 410 back. Alternatively, a plastic or polymer material rather than the label can be applied to the panel via an adhesive. Upon peeling label 412, reinforcing label 412 can deform, burst, shrink, delaminate, or otherwise indicate evidence of tampering.

Figure 5B:
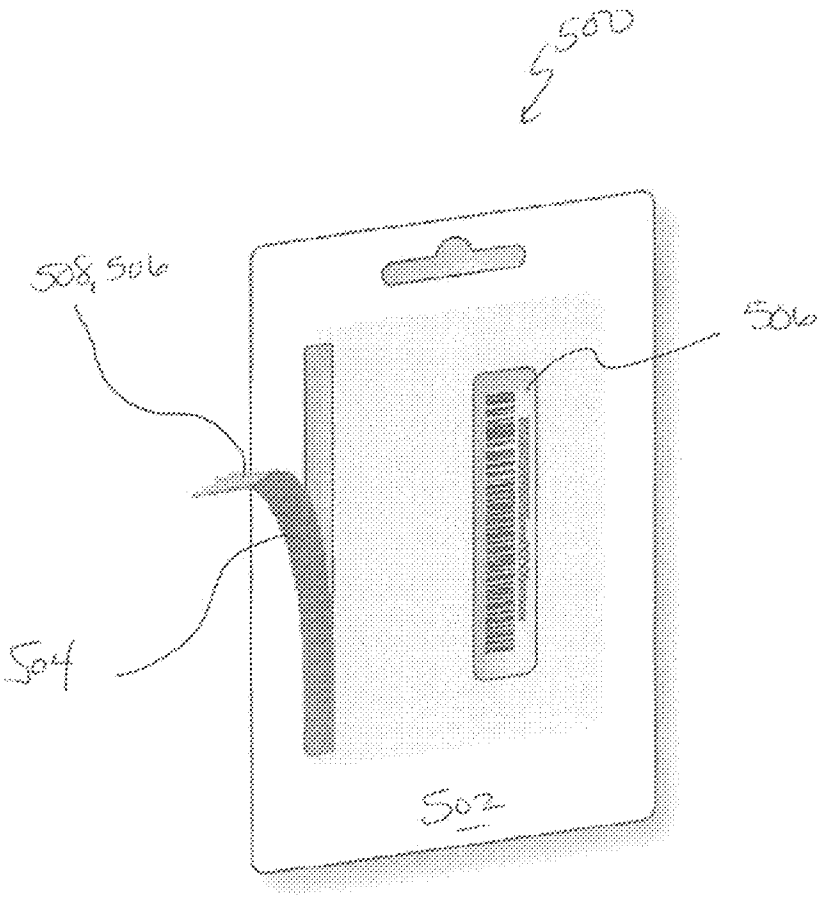
FIG. 5B is a back perspective view depicting the secure package assembly of FIG. 5A with a tear strip partially removed.
Figure 5A:
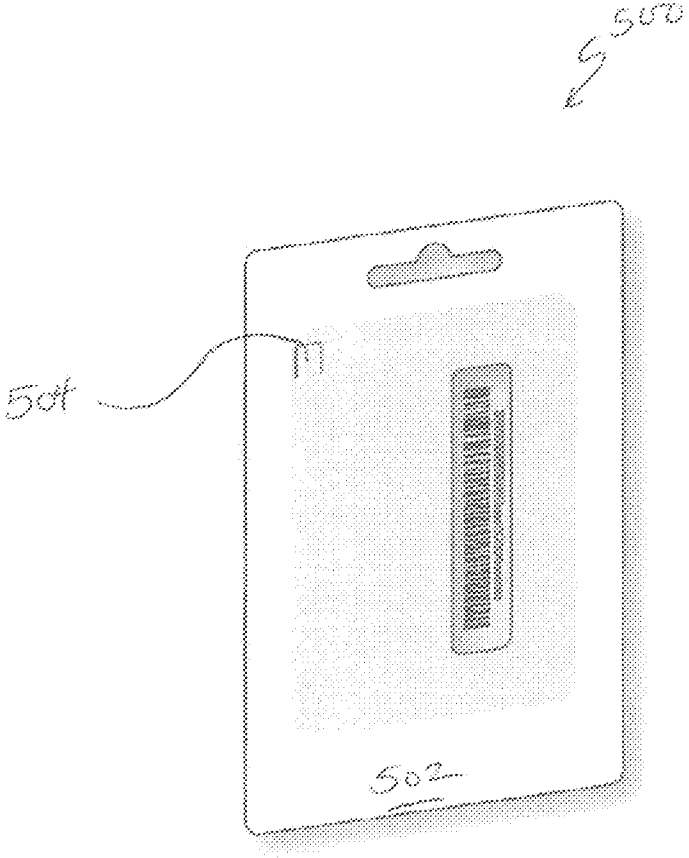
FIG. 5A is a back perspective view depicting a secure package assembly for stored value cards in accordance with a fifth embodiment of the disclosure.

Referring to FIGS. 5A-B, in another embodiment, secure pack 500 includes a stored value card C, front panel (not shown), and rear panel 502 with a tear strip 504 formed therein. Front panel and back panel 502 can comprise any of the materials described above, including a paper or polymer panel with a non-rewettable polymer layer 506 laminated thereto. Layer 506 is depicted in FIG. 5A as a transparent layer through which a portion of card C is viewable, although it is not limited to a transparent layer. A corresponding tear strip 508 can be formed in the underlying polymer layer 506, such that when the tear strip 504 of rear panel 502 is pulled back, the tear strip 508 of the polymer layer 506 is also pulled back, thereby indicating evidence of a package breach. Tear strips 504 and 508 can be formed of perforations, scores, die cuts, kiss cuts, or the like, or combinations thereof. Alternatively, the tear strip can be formed in a second polymer insert, in place of or in addition to the nonrewettable polymer layer 506.

Figure 6B:
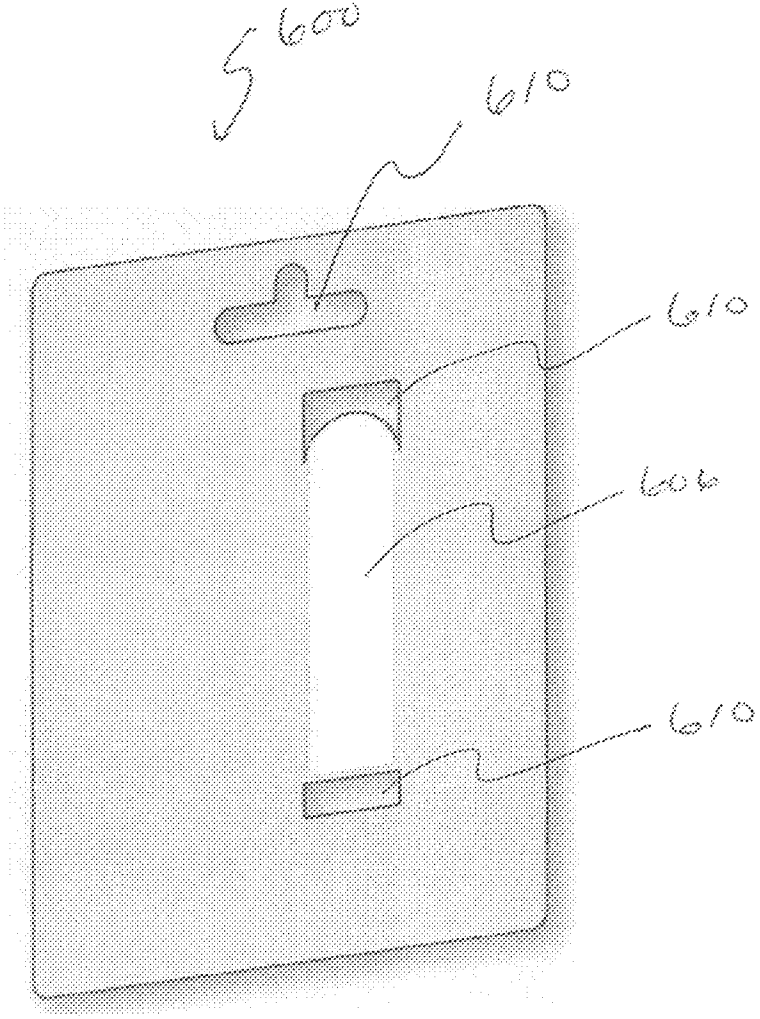
FIG. 6B is a perspective view depicting the rear component of secure package assembly of FIG. 6A in an assembled form.
Figure 6A:
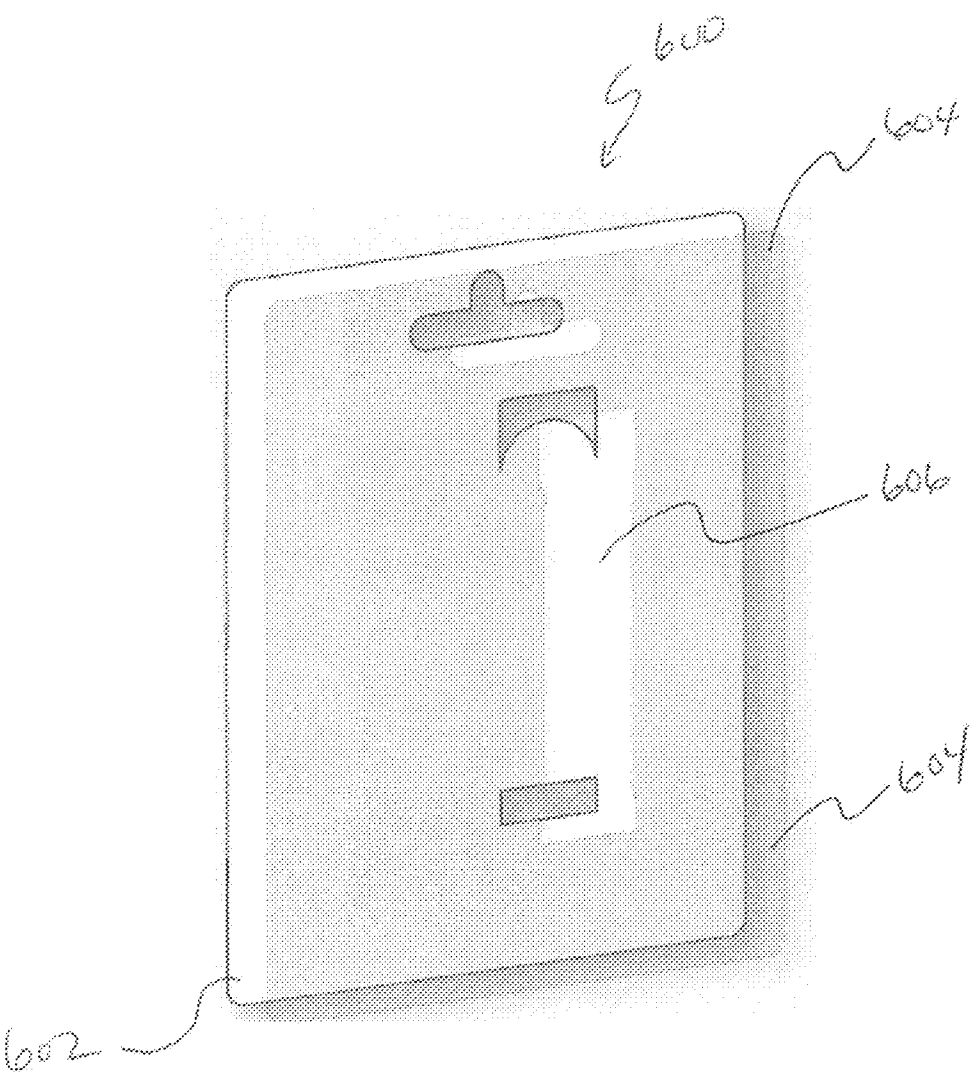
FIG. 6A is an exploded, perspective view depicting a rear component of a secure package assembly in accordance with a sixth embodiment of the disclosure.

Referring to FIGS. 6A-B, in another embodiment, secure pack 600 includes a stored value card (not shown) front panel (not shown), and back panel 602. Front panel and back panel 602 can comprise any of the materials described above, including a paper or polymer panel with a clear non-rewettable polymer layer 604 laminated thereto. In this embodiment, the polymer layer 604 can be spot laminated or adhered (via laminating adhesive) to back panel 602 in desired locations. A non-adhered portion 606 can be formed in the location of a perforated or scored tear tab (not shown) of back panel 602. In this embodiment, when the tear tab of back panel 602 is pulled back, non-adhered portion 606 does not peel back, and polymer layer 604 remains intact, such that activation indicia can be readable, yet not directly accessible. Back panel 602 and polymer layer 604 can also include corresponding apertures 610, such as hanging apertures, tear tab apertures, half-moon cutouts, perforations, and the like, or any combination thereof.

Figures 7A, 7B, 7C:
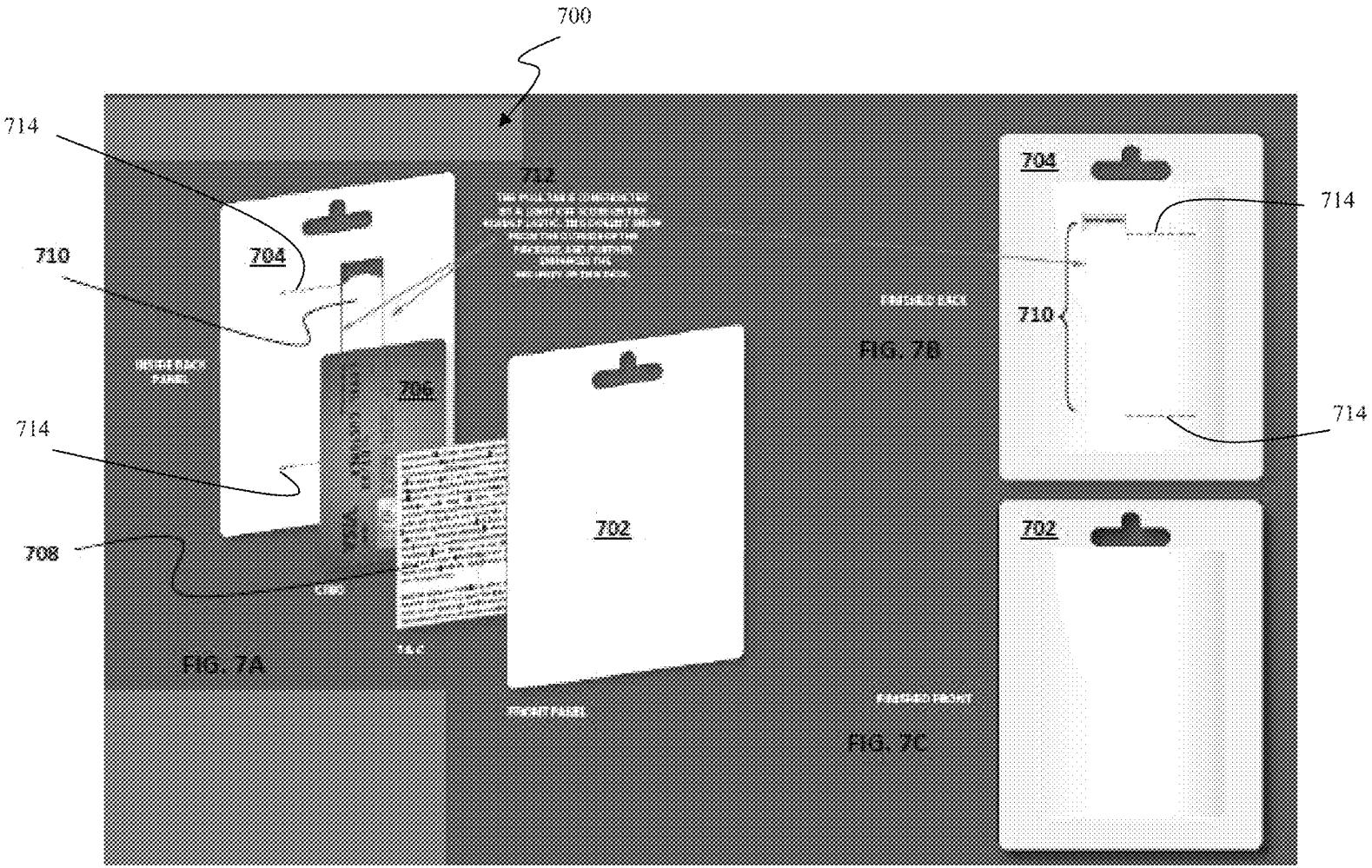
FIG. 7A is an exploded, perspective view depicting a secure package assembly for stored value cards in accordance with the seventh embodiment of the disclosure.
FIG. 7B is a plan view depicting a back panel of the secure package assembly of FIG. 7A.
FIG. 7C is a plan view depicting a front panel of the secure package assembly of FIG. 7A.

Referring to FIGS. 7A-C, in another embodiment, a secure pack 700 can include a front panel 702, a rear panel 704, at least one stored value card 706, and optional terms and conditions 708. In this embodiment, front panel 702 and rear panel 704 can be formed of a non-rewettable polymer material, such as PETG or APET that can be heat sealable onto itself. A thickness of each panel 702, 704 can be, for example, between approximately 6 mil and 15 mil, and more particularly between approximately 8 mil and 12 mil. Tear or pull tab 710 can be defined by a light score or kiss cuts 712 formed on an inner facing surface of rear panel 704 (or optionally front panel 702). In addition or alternatively, perforations 714 can extend from tab 710 for further rupturing assembly 700. Scores 712 and/or perforations 714 can create a controlled track for removing back tab 710 to access card 706 and/or information thereon or related thereto, such as activation indicia. For example, tab 710 can be opened via scores 712 to access activation indicia for activating card 706. Perforations 714 are then ruptured to access card 706. In an embodiment, scores 712 extend only partially through an inside surface of the rear panel 704 such that the tab 710 is not apparent from an exterior of pack 700, while perforations 714 extend entirely through the rear panel 704. In an alternative embodiment not shown, perforations 714 are replaced with scores that extend only partially through an inside surface of the panel such that these scores, like scores 712, are also not apparent from an exterior of pack 700, yet provide a controlled track for opening pack 700. In other embodiments, any combination of scores and perforations, whether extending only partially or entirely through the panel can be utilized.

In some embodiments, scores 712 can comprise straight lines. Referring to FIGS. 8A-K, in other embodiments, the scores can form any of a variety of non-linear configuration to enhance the indication of tampering.

Referring to FIG. 9A-C, in another embodiment, secure pack assembly 900 includes a rear panel 902, a front panel 904, and at least one stored value card 906 (optionally in a carrier) encapsulated within. Front panel 904 can be formed of a non-rewettable polymeric material, such as PETG, APET, or other materials as listed above, or combinations thereof. Front panel 904 can include a blister portion 907 or non-planar portion, such as a thermoformed blister, in which card(s) 906 (and optional carrier) are viewable therethrough. Front panel 904 can be entirely or partially transparent. For example, the sealed area may be translucent or opaque, while blister portion 907 can be transparent.

Front panel 904 can be sealed, such as by heat sealing, to rear panel 902 around card(s) 906. As depicted in FIG. 9A, rear panel 902 can be formed of a paper backing 902*a* with a non-rewettable polymer layer 902*b* or insert coupled thereto. In this embodiment, in which the panel can be a combination of paper and polymer layer, the polymer layer 902*b* can comprise a thickness between approximately 1 mil and 6 mil, and more particularly between approximately 2 mil and 4 mil. Polymer layer 902*b* can comprise PETG, APET, or other materials as listed above, or combinations thereof. Polymer layer 902*b* can be formed of the same material as front panel 904, or can be a different material that can form a non-rewettable tamper evident seal to the material of front panel 904. Alternatively, the rear panel 902 can be formed entirely of non-rewettable plastic material.

Rear panel 902 can optionally include a tear or pull tab 908 and/or other tear portions 909 for accessing card 906 and/or indicia on card 906, such as, for example, activation indicia, as described above. Tab 908 and other tear portions 909 can be formed of scores and/or perforations 908*a*, either entirely through rear panel 902, or only partially through rear panel 902, such that their presence is not evident from an exterior of rear panel 902, yet forms a track for a controlled, tamper evident opening, and/or entirely through panel 902. Assembly 900 can further optionally include hanging apertures, terms and conditions, tear strips, printing, embossing, foiling, lenticular or other lens features, and/or any combination as describe herein.

Referring to FIGS. 10A-D, in another embodiment, secure pack 1000 can include one or more stored value cards 1002 and a multi-panel carrier 1004. Carrier 1004 can be made of paper materials of composition and thickness suitable for secure transaction card packaging applications. Carrier 1004 can include a first or front panel 1010, a second or back panel 1020, and optional card panel 1030 that is foldable to sandwich card 1002 and panel 1030 between front panel 1010 and back panel 1020. Front panel 1010, back panel 1020, and card panel 1030 include fold lines 1035 at their intersections.

In another embodiment, only front panel 1010 and back panel 1020 make up carrier 1004, and stored value card 1002 can be adhered directly to either to front panel 1010 or back panel 1020, thereby eliminating the need for card panel 1030. Alternatively, carrier 1004 can include additional panels to front panel 1010, back panel 1020, and card panel 1030 and can be similarly configured to fold along a plurality of fold lines 1035 such that carrier 1004 folds into itself. In yet other alternative embodiments, carrier 1004 includes a single panel carrier with a blister pack or other sealing mechanism for sealing the card(s) within the secure packaging system.

Figure 10A:
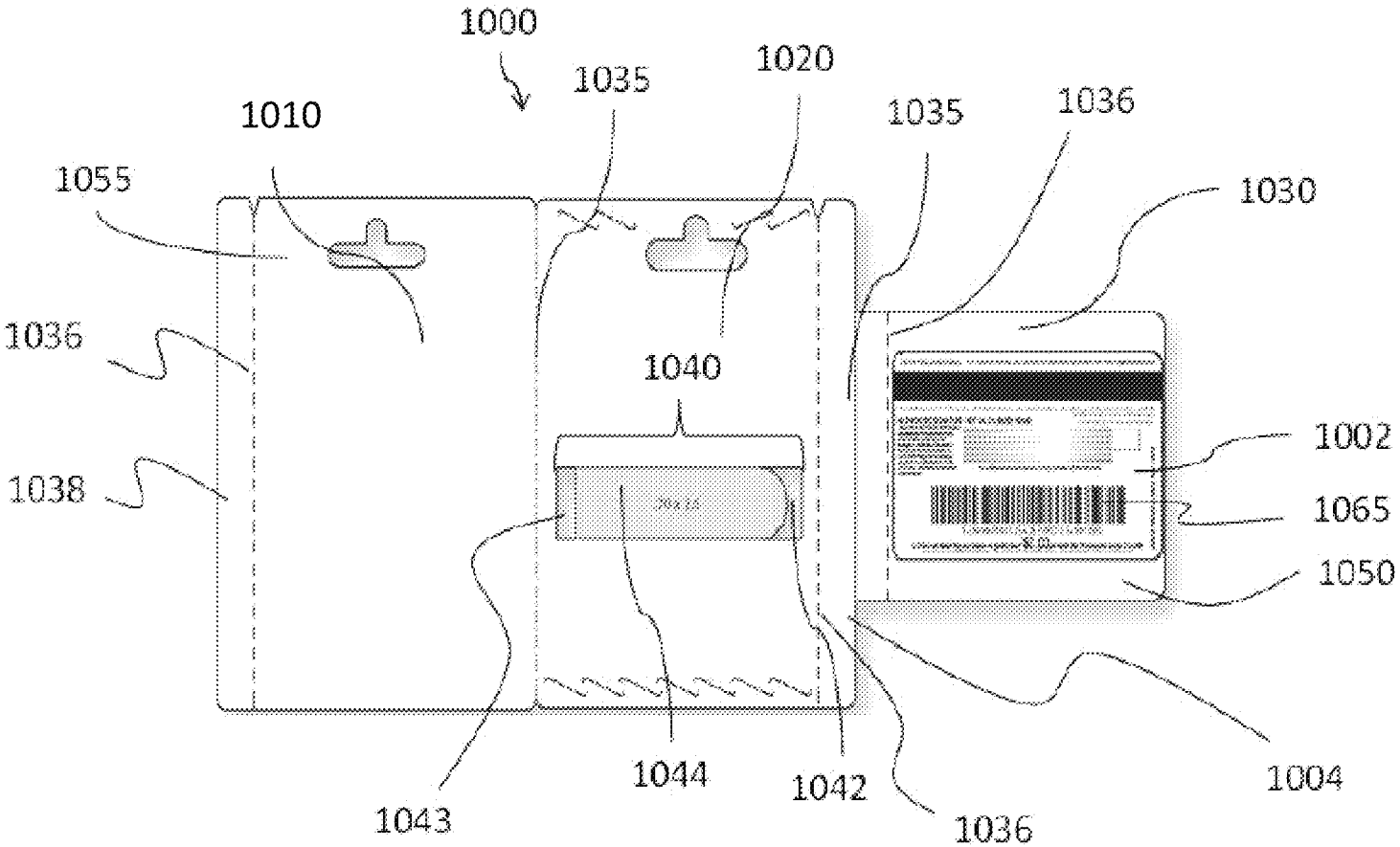
FIG. 10A is a plan view depicting an inner surface of an unfolded secure package assembly with label according to a ninth embodiment of the disclosure.

With reference to FIG. 10A, in an embodiment, a panel of carrier 1004, such as, but not limited to, back panel 1020 includes a tear or pull tab 1040, including a half moon cutout 1042 on a first end for graspable access by the cashier or user, and an aperture 1043 on a second end. On the inside of back panel 1020 (i.e. the side that faces stored value card 1002), a reinforcing label 1044 can be placed over tab 1040. Tab 1040 and label 1044 can be arranged on the back panel 1020, such that tab 1040 and label 1044 cover the activation indicia 1065 of stored value card 1002 when card panel 1030 is folded over back panel 1020 (as depicted in FIG. 10C). Reinforcing label 1044 can be configured to have a material strength greater than that of the paper material of carrier 1004. For example, reinforcing label 1044 can be made of any of a variety of polymeric materials, such as, but not limited to, polyethylene terephthalate glycol-modified (PETG), or other suitable plastic. Reinforcing label 1044 can be secured to tab 1040 by adhesive, heating sealing, or any of a variety of adhering mechanisms.

As an alternative to reinforcing label 1044, back panel 1020 can be reinforced in an area of pull tab 1040 by applying or adhering a strip or section of a paper material thereto, and/or a reinforcement layer or coating, such as, for example, a rubber or rubber-like coating that can be printed or otherwise applied to the carrier 1004 and aids in preventing the panel 1020 from unwanted tearing when the pull-tab is pulled back.

In one embodiment, a longitudinal axis of tab 1040 and label 1044 can be substantially parallel to a direction of the paper grain of back panel 1020 such that no perforations are needed in panel 1020 for peeling back tab 1040. In other embodiments, kiss cuts and/or perforations may be added to back panel 1020, such that they are adjacent to the edges of label 1044, thereby serving as an aid in tearing.

In operation, a user grasps the tab 1040 proximal to the half moon cutout 1042 (and consequently, the adjacent end of label 1044 adhered to tab 1042), then pulls away from back panel 1020 to expose activation indicia 1065 of card 1002. Because the tear strength of the paper material of carrier 1004 is less than the tear strength of label 1044, tab 1040 separates from the remaining material of back panel 1020 around label 1044, leaving label 1044 substantially intact. One of skill in the art would recognize that tab 1040 can be formed on any panel of a single or multi-panel carrier and is not limited to back panel 1020.

Figure 10B:
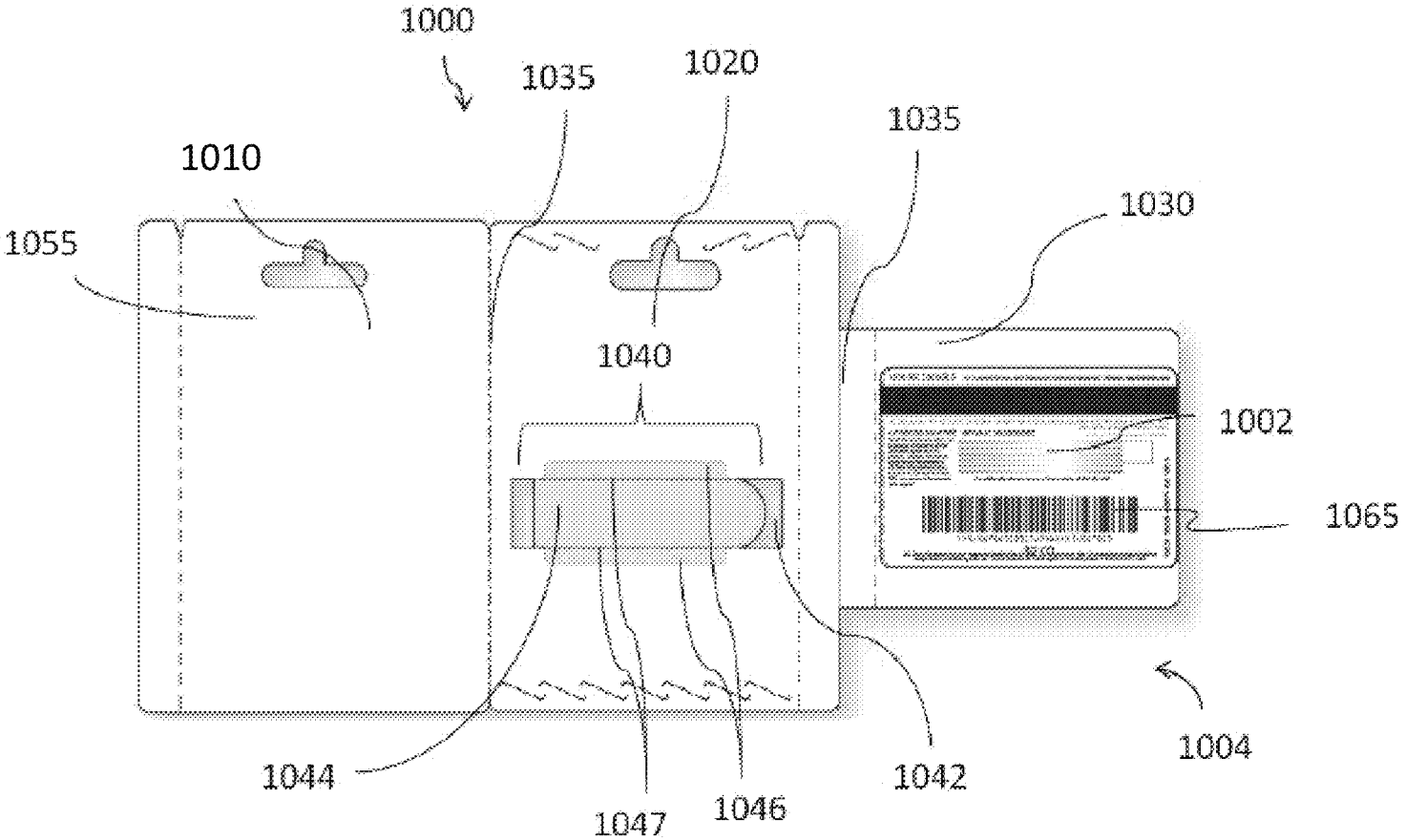
FIG. 10B is a plan view depicting an inner surface of an unfolded secure package assembly of FIG. 10A having a perforated label.
Figure 10D:
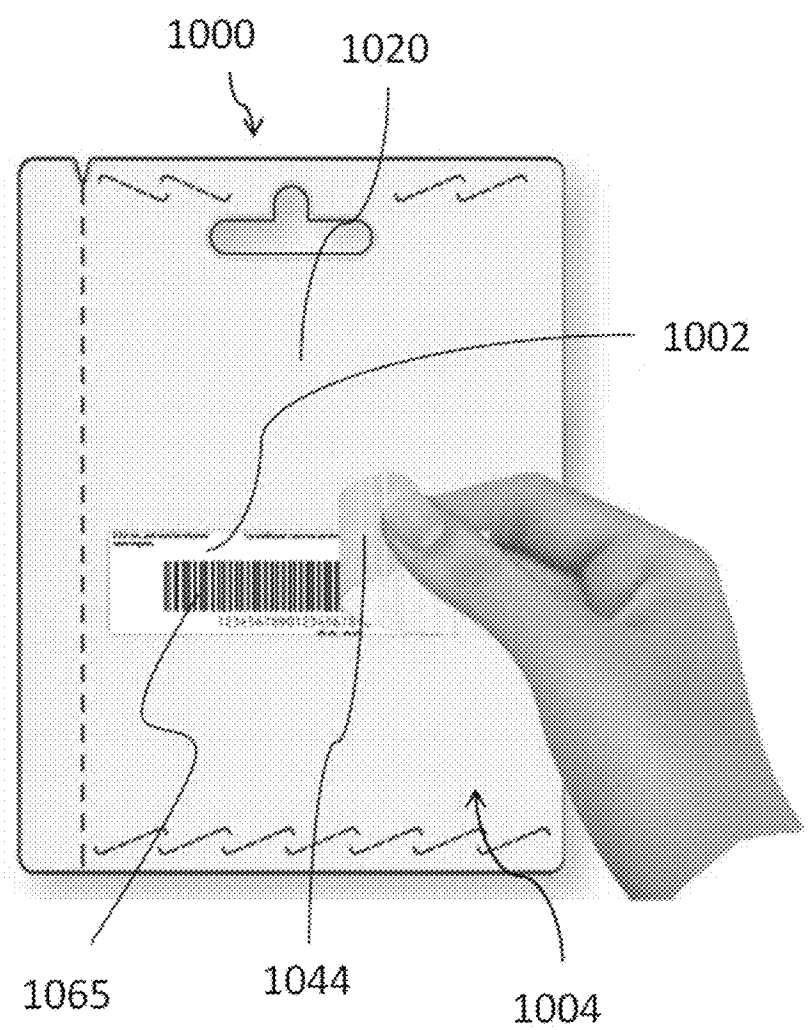
FIG. 10D is a rear view depicting the assembled secure package assembly of FIG. 10A, with a pull tab pulled back to expose activation indicia.
Figure 10C:
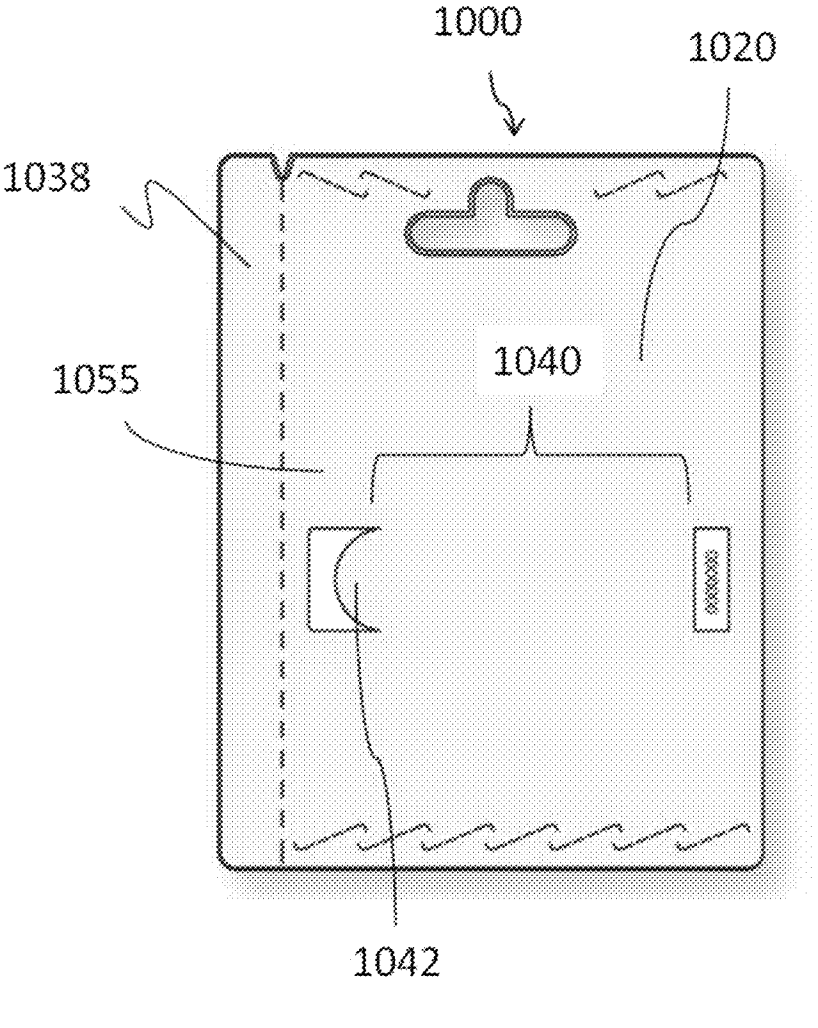
FIG. 10C is a rear view depicting the assembled secure package assembly of FIG. 10A.

With reference to FIG. 10B, and an alternative embodiment, label 1044 can include extension flaps 1046. Extension flaps 1046 can extend from one or both long edges of label 1044 and are optionally segmented by perforations 1047, or similar, on either side of label 1044. Label 1044 can be adhered to tab 1040 and can extend past tab 1040 onto back panel 1020 to provide additional reinforcement to back panel 1020 around the area of tab 1040. In this embodiment, tab 1040 is pulled back along with label 1044, as is previously discussed; however, the extension flaps 1046 separate from label 1044 via perforations 1047 to remain adhered to back panel 1020 in order to fortify the intentionally torn edge of back panel 1020 surrounding label 1044.

With reference to FIGS. 10A-B, during assembly, stored value card 1002 can be adhered to secure pack 1000 at card panel 1030, such as by a removable or fugitive adhesive. Optional terms and conditions can also be couple to card panel 1030, or other panels. Card panel 1030 and stored value card 1002 are then folded toward the inside of back panel 1020 at adjacent fold line 1035 and activation indicia 1065 aligns with tab 1040. Optionally, card panel 1030 can then be sealed to back panel 1020 around a perimeter of card 1002 to form first sealing region 1050 via adhering agents such as, for example, permanent adhesive or glue, non-rewettable adhesive, heat sealing materials, and/or other suitable sealing methods. Alternatively, card panel 1030 can be folded only, and not adhered to back panel 1020. Then, front panel 1010 can be folded toward the inside surface of back panel 1020 at another adjacent fold line 1035. Front panel 1010 can then be sealed to back panel 1020 and card panel 1030 at second sealing region 1055 around a perimeter of card panel 1030 via adhering agents such as, for example, permanent adhesive or glue, non-rewettable adhesive, heat sealing materials, and/or other suitable sealing methods. Because the seal formed at second sealing region 1055 is the final seal, it is contemplated that this seal be robust enough to only allow access to stored value card 1002 by tearing the paper material of carrier 1004.

Referring now to FIGS. 10A-10-D, optionally, panels 1010, 1020, and/or 1030 can include a corresponding separating mechanism 1036, such as perforations, scores, die cuts, kiss cuts, or the like, that when carrier 1004 is assembled, form tear strip 1038 along an edge thereof. Tear strip 1038 can be removed or separated from remaining carrier 1004 to allow access to card 1002 and card panel 1030 for removing card 1002 after purchase and activation.

Figure 11A:
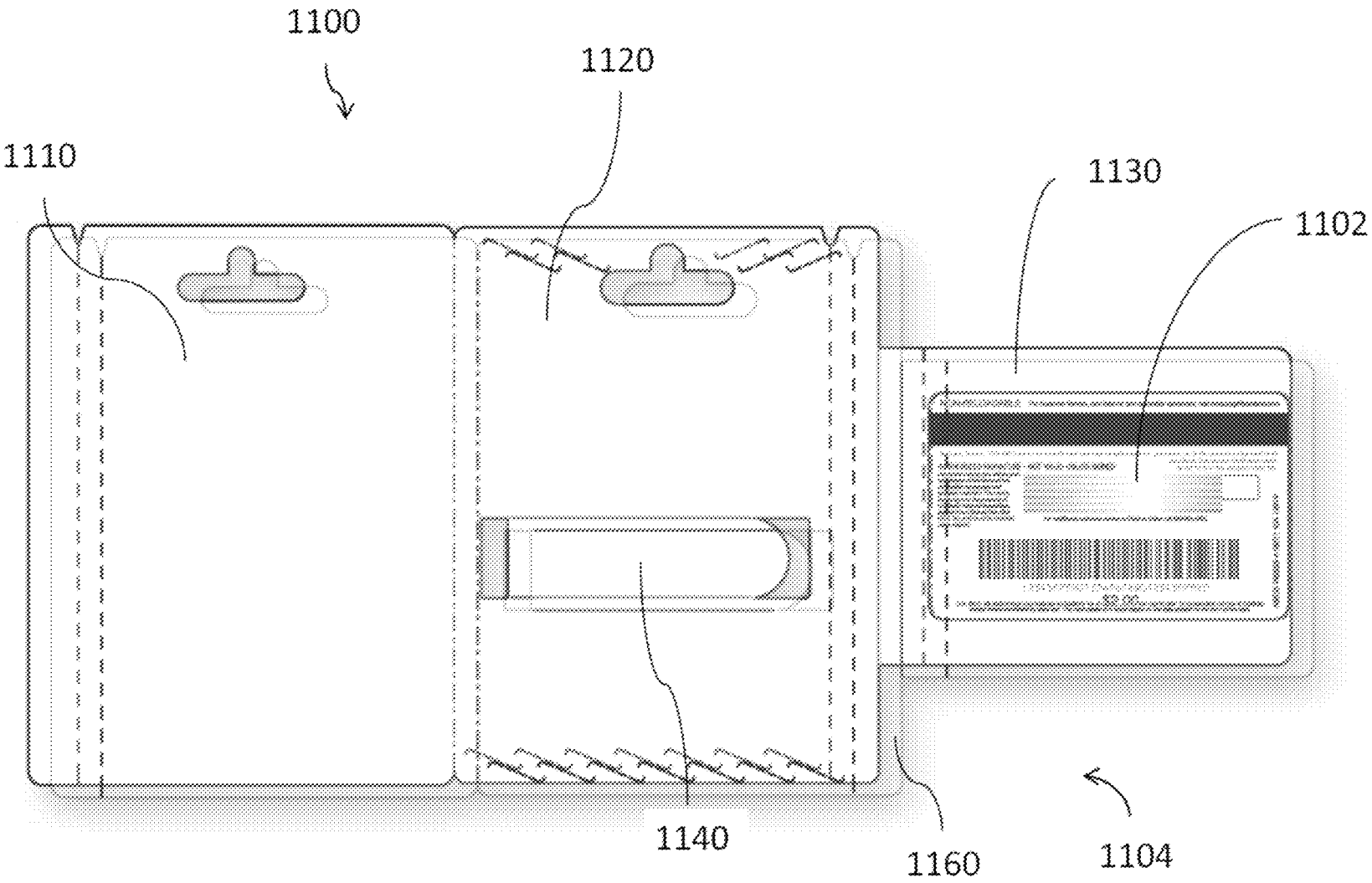
FIG. 11A is an exploded, plan view depicting an inner surface of an unfolded secure package assembly with polymeric insert according to a tenth embodiment of the disclosure.
Figure 11B:
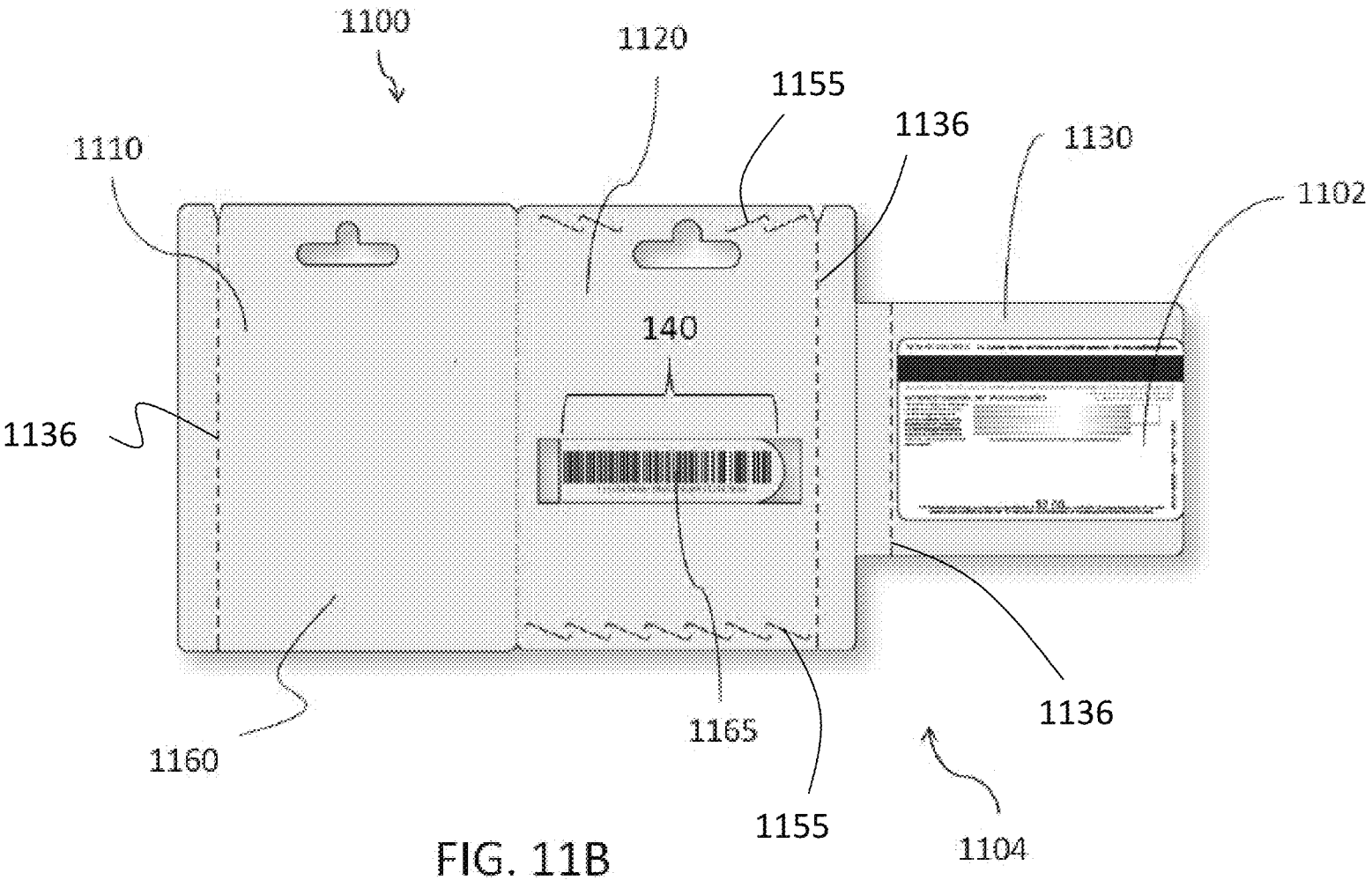
FIG. 11B is a plan view depicting the unfolded secure package assembly with polymeric insert of FIG. 11A in a partially assembled state.
Figure 11C:
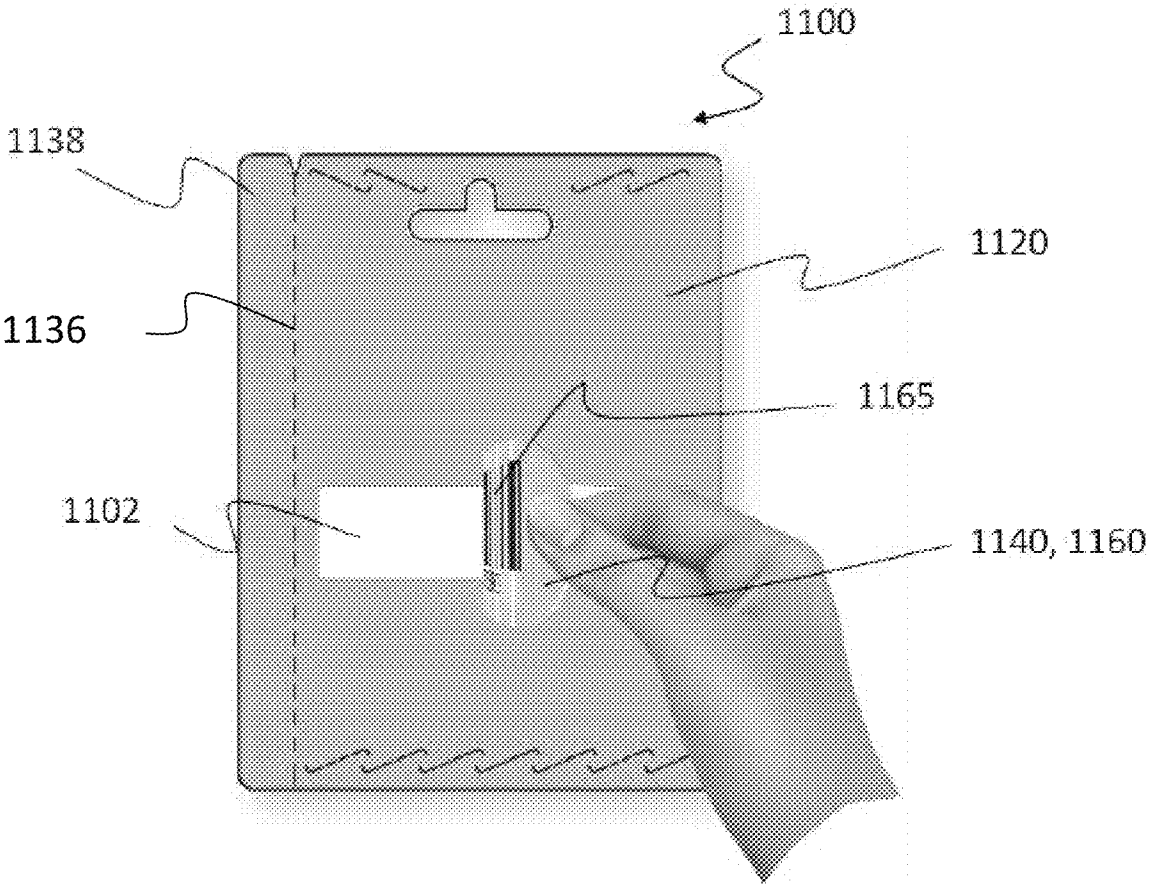
FIG. 11C is a rear view depicting the assembled secure package assembly of FIG. 11B.

Referring to FIGS. 11A-C, in another embodiment, secure pack 1100 can include a carrier 1104 (similar to carrier 1004 of previous embodiments), having a polymeric, non-rewettable layer 1160 adhered or coated to the inner surface of one or more panels 1110, 1120, 1130 (or portions thereof) of carrier 1104 by adhesive, lamination, heat sealing, or other suitable adhering method. In one embodiment, polymeric insert 1160 covers an entirety of the inner surface of carrier 1104, while in other embodiments, polymeric insert 1160 can cover only certain segments or portions of carrier 1104, instead of an entirety.

Polymeric insert 1160 can be made of polyethylene terephthalate glycol-modified (PETG), or other suitable polymeric or non-rewettable polymeric insert material. Because of the heat sealable properties of polymeric insert 1160, the seal formed at sealing regions 1155 can be produced by heat sealing the polymeric insert covered portions of back panel 1120 and front panel 1110 that make contact in the folded orientation without glue or other adhesives. Alternatively, a permanent or tamper evident adhesive can used to seal secure pack 1100. In this embodiment, when secure pack 1100 is heated for the purpose of softening the adhesive to gain otherwise unnoticeable access to secure pack 1100, polymeric insert 1160 will have plastically deformed, i.e. started melting, such that tampering is evident.

Polymeric insert 1160 can be perforated, kiss cut, or otherwise scored around the intended tab 1140 such that, in the tab area, a portion of polymeric insert 1160 separates from the remaining polymeric insert 1160, and remains adhered to tab 1140 when tab 1140 is pulled back to ease opening of tab 1140. Alternatively, a label (not shown) can be added between polymeric layer 1160 and back panel 1120 or over polymeric layer 1160 to further fortify and ease removal of tab 1140. Polymeric layer 1160 further provides additional tamper proof evidence as it must be ruptured when removing tab 1140 in order to access activation data. Various embodiments of labels and their incorporation into secure packs are further described in U.S. application Ser. No. 15/585,953, filed May 3, 2017, and entitled "Stored Value Card and Carrier Assembly with Tamper Evident Label," incorporated herein by reference in its entirety.

Similar to the embodiments described above, a longitudinal axis of tab 1140 can be substantially parallel to a direction of the paper grain of back panel 1120, such that no perforations are required in panel 1120 for proper peeling back tab 1140. In other embodiments, kiss cuts and/or perforations can be added to back panel 1120, to defined edges of tab 1140 and aid in tearing.

With reference to FIGS. 11B and 11C, in alternative embodiments, activation indicia 1165 can be printed directly on tab 1140, polymeric layer 1160, on a label (not shown) applied to tab 1140, or any combination thereof, instead of or in addition to being applied directly to card 1102. Accordingly, upon the peeling back of tab 1140, the activation indicia 1165 can be readable or scannable.

Secure pack 1100 can be assembled and sealed similar to the embodiments described above. Secure pack 1100 can optionally have various perforations around the second sealing region 1155, such as perforations 1136 forming tear strip 1138, in order to aid in an intended edge removal and package access. Providing access to stored value card 1102 only through perforated edges ensures the user that if the card was fraudulently access prior to purchase, the torn edges would be evident.

In any of the embodiments, the non-rewettable material polymer can be a material, such as, for example, APET or PETG, which can become brittle over time and/or during manufacturing of the secure pack. Due to increased brittleness over time and/or from processing, the material may then fracture when trying to open the package to remove the card, which can further show evidence of tampering.

All of the embodiments as described above can optionally incorporate conventional retail components such as terms and conditions, hook hanging cut outs, tear strips, dash or cut scores, perforations, and/or other necessary features of retail sale.

Additional tamper evident carrier assemblies and stored value cards can also be combined with the embodiments described above including tamper evident labels as described in U.S. Patent Application Publ. No. 2017/0243098, filed Feb. 22, 2017, and U.S. patent application Ser. No. 15/585,953, filed May 3, 2017, both entitled "Stored Value Card and Carrier System with Tamper Evident Label," both of which are incorporated herein by reference in their entireties.

In general, stored value cards according to embodiments are forms of transaction instruments associated with transaction accounts, in which the stored value cards provide cash equivalent value that may be used within an existing payment/transaction infrastructure. Stored value cards are frequently referred to as gift, pre-paid or cash cards, in that money is deposited in an account associated with the card before use of the cards is allowed. In general, such an account may be used for transactions between a user and a merchant through any suitable communication mechanism, such as, for example, a telephone network, intranet, the global, public Internet, a point of interaction device, online communications, off-line communications, wireless communications, and the like. They may also be used in person at any point of sale (automated or not) that accepts them. The type of stored value card may be a gift card, loyalty card, credit or debit card, health card, phone card, pre-paid phone card, membership card, identification card, ring tone card, or any other type of card. The stored value card may be any such transaction instrument associated with any such transaction account.

The stored value card is typically the size and shape of a conventional credit card (i.e., CR80 card), although other sizes and shapes are possible, such as, for example, card and carrier embodiments depicted and described in U.S. Patent Publ. No. 2016/0031624, filed Jul. 30, 2015, incorporated by reference in its entirety above. The stored value card is commonly made of plastic, wood, or paper, however other materials, such as other synthetic or natural materials are also contemplated.

The stored value card includes an account identifying element that relates to or is incorporated in the authorization data that is mentioned above, such as a magnetic stripe, radiofrequency identification (RFID), bar code, QR code, text (recognized by Optical Character Recognition (OCR)), and/or smart chip, for example. The account identifying element is encoded with data, which includes a unique account number. If the stored value card includes a magnetic stripe, that magnetic stripe can comprise a plastic film including tiny magnetic particles that can be magnetized in certain directions to record data on the card, which can be read by a card reader. If the stored value card includes a bar code, the bar code can comprise machine-readable data, which can be alpha-numeric. Bar code data includes black and white lines arranged to represent a series of numbers (e.g., a bar code comprising a Universal Product Code (UPC) has twelve digits) to a bar code scanner (printed account identifying elements). Other current or future developed account identifying elements are also possible. Also, more than one account identifying element can be included on the stored value card, and in any location.

The stored value card can include embossed or non-embossed features, such as an account number, card issuer name or logo, card holder's name, expiration date, etc. An account identifying element(s) on the stored value card can be embossed (including at least one raised portion (e.g., letters, designs), or protuberance, etc.), or non-embossed.

A main advantage to all of the above embodiments is that there is no need to alter or special order the stored value cards or carrier assemblies provided by the card and carrier distributor. This means a less expensive and efficient interaction between the card and carrier distributor and the security packaging manufacturer.

Further, the embodiments described herein all incorporate a heat sealed non-rewettable encapsulation around the stored value card and carrier. In particular, this type of seal does not separate when wetted by a solvent, re-heated, or pried with a sharp edge. These tactics are common to fraudsters who wish to access the stored value card information and reclose the packaging undetected.

Certain embodiments incorporate a necessary tearing of one or more layers of packaging material. Tearing results in an erratic and noticeable edge that is in most cases permanently severe. Because of this the tear is visible to consumer or cashier and, further, the tear is irreparable by a fraudster.

In all embodiments, the non-rewettable polymer layer can comprise APET, PETG, polycarbonate, polyethylene, or combinations thereof. Each of the panels can be clear, opaque (color or white), semi-opaque (color or white), or any combination thereof. The inner and/or outer layers or surfaces of the panels can printed, decorated, embellished, or otherwise adorned by any of a variety of mechanisms including, but not limited to, conventional and/or digital printing, metallization foil lamination, foil stamping, embossing, lenticular or lens arrays and associated imaging, and/or screen printing. Any combination of pull tabs, tear strips, or other means of accessing the package are contemplated, in which they are formed by die cut, kiss cuts, dash or cut, scoring, and/or perforating the package at least partially through the non-rewettable polymer layer. In other embodiments, the panels do not contain any such mechanisms.

In any of the embodiments, the panels can be discrete or can be foldable relative to one another. Additional discrete and/or foldable panels, such as an inner panel for securing the card thereto, can also be incorporated.

In any of the embodiments, adhesives such as fugitive glues and/or permanent adhesives can be incorporated to add additional bonding of the packaging. In one embodiment, a fugitive adhesive is used to secure the card to the panel. The fugitive glue remains adhered to the panel when the card is removed, such that the card is not damaged and is cleanly removed.

Various embodiments of assemblies, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A secure packaging system for a stored value card, the secure packaging system comprising:

a stored value card; and a carrier assembly including a front panel comprising a first paper and a first non-rewettable polymer laminated to an inner facing surface of the first paper, and a back panel comprising a second paper and a second non-rewettable polymer laminated to an inner facing surface of the second paper, wherein the back panel and front panel are sealed to each other via the first and second non-rewettable polymers, only around a periphery of the stored value card and defining a sealing section, wherein the sealing section cannot be re-activated or unsealed with heat to access the contents therein, and wherein an orientation of a grain of the first paper of the front panel is of an orientation different than an orientation of a grain of the second paper of the back panel to reduce curling of the carrier assembly when sealed.

2. The secure packaging system of claim 1, wherein the carrier assembly includes a structure defining a tear strip positioned adjacent an edge of the sealed front and back panels, wherein the tear strip is configured to be irreversibly torn to access the stored value card.

3. The secure packaging system of claim 1, wherein the first and second non-rewettable polymers are selected from at least one material of APET, PETG, and polycarbonate.

4. The secure packaging system of claim 1, wherein the orientation of the grain of the front panel has an orientation approximately perpendicular to the orientation of the grain of the back panel.

5. The secure packaging system of claim 1, wherein the front and back panels are discrete panels.

6. A secure packaging system for a stored value card, the secure packaging system comprising:

a stored value card; and a carrier assembly including:

a front panel, and a back panel sealed via a non-rewettable polymer to the front panel at a non-rewettable sealing section, the sealing section arranged around only a periphery of the stored value card, wherein the sealing section cannot be re-activated or unsealed with heat to access the contents therein, wherein the non-rewettable polymer is selected from at least one of APET and PETG, wherein at least one of the front panel or the back panel includes a structure defining a pull tab for accessing indicia on or related to the stored value card, and wherein the structure defining the pull tab comprises a kiss cut extending only partially through the panel such that the pull tab is not observable from an exterior of the secure packaging system until ruptured.

7. The secure packaging system of claim 6, wherein the front and back panels are formed entirely of APET, PETG, or combinations thereof such that the front and back panels form the non-rewettable polymers.

8. The secure packaging system of claim 6, wherein at least one of the front and back panels are made of a polymer and the non-rewettable polymer laminated to an inside surface of the polymer.

9. The secure packaging system of claim 6, wherein at least one of the front or back panels are formed entirely of the non-rewettable polymer and comprises the structure defining the pull tab.

10. The secure packaging system of claim 6, wherein at least one of the front or back panels comprise paper and the non-rewettable polymer laminated to an inner facing surface of the paper, and wherein the structure defining the pull tab comprises the kiss cut extending only through the non-rewettable polymer and not through the paper such that the pull tab is not observable from an exterior of the secure packaging system until ruptured.

11. The secure packaging system of claim 6, wherein the front and back panels are formed from the same substrate and are separable from one another by a fold or score line.

12. The secure packaging system of claim 6, wherein at least one of the front or back panels includes a tamper evident mechanism configured to provide access to the card, information on the card, or combinations thereof.

13. The secure packaging system of claim 6, wherein each of the front and back panels are one of clear, opaque (color or white), semi-opaque (color or white), and any combination thereof.

14. The secure packaging system of claim 6, wherein at least one of the front or back panels is printed, decorated, embellished, or otherwise adorned by at least one of conventional or digital printing, metallization foil lamination, foil stamping, embossing, lenticular or lens arrays and associated imaging, or screen printing.

15. The secure packaging system of claim 6, wherein the panel containing the pull tab comprises paper and the non-rewettable polymer, and wherein a longitudinal axis of the pull tab is parallel to a grain direction of paper forming the panel.

16. A secure packaging system for a stored value card, the secure packaging system comprising:

a stored value card; and a multi-panel carrier comprising a front panel, a rear panel, and a card panel, the card panel being connected and foldable relative to the front or back panel, wherein the stored value card is attached to the card panel, wherein the front and rear panels are folded relative to one another about a fold line so as to at least partially encapsulate the card panel and the stored value card, and wherein the back panel is sealed via a non-rewettable polymer to the front panel only around a periphery of the stored value card and defining a sealing region, wherein the sealing region cannot be re-activated or unsealed with heat to access the contents therein, wherein at least one of the front panel or the back panel includes a structure defining a pull tab for accessing indicia on or related to the stored value card, and wherein the structure defining the pull tab comprises a kiss cut extending only partially through the panel such that the pull tab is not observable from an exterior of the carrier assembly until ruptured.

17. The secure packaging system of claim 16, wherein the multi-panel carrier includes structure defining a tear strip positioned adjacent an edge of the sealed front and back panels, wherein the tear strip is configured to be irreversibly torn to access the stored value card.

18. The secure packaging system of claim 16, wherein the multi-panel carrier is formed of or incorporates the non-rewettable polymer, wherein the non-rewettable polymer is selected from at least one of APET and PETG.

19. The secure packaging system of claim 16, wherein the multi-panel carrier comprises paper and the non-rewettable polymer laminated to an inner facing surface of the paper of at least one panel, wherein the non-rewettable polymer is selected from at least one of APET and PETG.

20. The secure packaging system of claim 16, wherein the multi-panel carrier is formed entirely of the non-rewettable polymer.

21. The secure packaging system of claim 16, wherein the multi-panel carrier includes a tamper evident mechanism configured to provide access to the card, information on the card, or combinations thereof.

22. The secure packaging system of claim 16, wherein the panel containing the pull tab comprises paper and the non-rewettable polymer, and wherein a longitudinal axis of the pull tab is parallel to a grain direction of paper forming the panel.

* * * * *